US006406133B1

(12) United States Patent
Abe

(10) Patent No.: US 6,406,133 B1
(45) Date of Patent: Jun. 18, 2002

(54) ELECTROSTATIC INK JET HEAD AND METHOD OF PRODUCING THE SAME

(75) Inventor: Shuya Abe, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/632,047

(22) Filed: Aug. 3, 2000

(30) Foreign Application Priority Data

Aug. 6, 1999 (JP) ..... 11-224541
Aug. 3, 2000 (JP) ..... 2000-214078

(51) Int. Cl.[7] ..... B41J 2/06
(52) U.S. Cl. ..... 347/55
(58) Field of Search ..... 347/55, 68, 69, 347/54, 70, 71, 72, 50, 40, 20, 44, 47, 27, 63; 399/261, 271, 290, 292, 293, 294, 295; 361/700; 310/328–330; 29/890.1

(56) References Cited

FOREIGN PATENT DOCUMENTS

| | | |
|---|---|---|
| JP | 1061308 | 3/1989 |
| JP | 5-50601 | 3/1993 |
| JP | 6-71882 | 3/1994 |
| JP | 7125196 | 5/1995 |
| JP | 9148062 | 6/1997 |
| JP | 9193375 | 7/1997 |

*Primary Examiner*—Raquel Yvette Gordon
(74) *Attorney, Agent, or Firm*—Cooper & Dunham LLP

(57) ABSTRACT

An electrostatic ink jet head includes nozzles, ink passages, a diaphragm that forms a part of the ink passages, individual electrodes that face the diaphragm. A driving voltage is applied between a common substrate formed on the diaphragm and the individual electrodes, thereby generating electrostatic force. The diaphragm is deformed by the electrostatic force. As a result, the ink in the ink passages are pressurized, so that ink droplets are discharged through the nozzles. Spacers are employed to form a gap between the diaphragm and each individual electrode. At least one of the spacers is made of the same material as the individual electrodes, so that the individual electrodes have high voltage resistance. Furthermore, voltage of both polarities can be used, and gap formation can be carried out with high precision through simpler production steps.

15 Claims, 24 Drawing Sheets

ELECTROSTATIC INK JET HEAD AND METHOD OF PRODUCING THE SAME

BACKGROUND OF THE INVENTION

1. Field of the Invention

The present invention generally relates to an ink jet head and a method of producing the same. More particularly, the present invention relates to an ink jet head that discharges ink droplets by driving a diaphragm with electrostatic force between electrodes on the diaphragm side and electrodes that face the diaphragm-side electrodes, and to a method of producing such an ink jet head.

2. Description of the Related Art

Japanese Laid-Open Patent Application No. 7-125196 discloses an electrostatic ink jet head that comprises a diaphragm, a substrate integrally formed with the diaphragm, and individual electrodes that face the diaphragm, with a gap being interposed between the diaphragm and the individual electrodes. In this ink jet head, the individual electrodes are formed in concave portions formed in an insulating member, and the gap is defined as: (the depth of each concave portion of the insulating member (or the height of each step portion))–(the thickness of each individual electrode). The individual electrodes and the diaphragm electrodes can be pulled out on the same planes, respectively, so that electric voltage can be applied to them.

Japanese Patent Application No. 9-148062 discloses an electrostatic ink jet head that comprises a diaphragm and individual electrodes which face the diaphragm, with a gap being maintained between the diaphragm and the individual electrodes. In this ink jet head, the individual electrodes are formed in concave portions formed in a glass substrate, and the gap is defined as: (the height of each step of the glass substrate)–(the thickness of each individual electrode). Through holes for embedding conductors in the glass substrate are formed, and conductors are embedded in the through holes. The individual electrodes are pulled onto the bottom surface of the glass substrate through the conductors, and are mounted via bump-like conductors. A voltage is then applied.

Japanese Patent Application No. 10-61308 discloses an electrostatic ink jet head in which individual electrodes are formed by a diffusion layer in a silicon substrate. Through holes for pulling out the electrodes onto the silicon substrate are formed, so that the potential of the individual electrodes can be taken out onto the bottom surface of a supporting substrate. After the formation of the through holes, the electrodes are formed by the diffusion layer.

Japanese Laid-Open Patent Application No. 5-50601 discloses an electrostatic ink jet head in which the diaphragm is deformed by electrostatic force generated by a voltage applied between the diaphragm and electrodes facing the diaphragm, thereby discharging ink droplets. Each diaphragm chamber (gap) is formed by a concave portion in a diaphragm substrate. A lower substrate (electrode substrate) also has concave portions. The individual electrodes are placed in the concave portions, so as to prevent short-circuiting with the diaphragm.

Japanese Laid-Open Patent Application No. 6-71882 discloses an electrostatic ink jet head in which the gap between the diaphragm and each facing electrode is in the range of 0.05 $\mu$m and 2.0 $\mu$m, so that the ink jet head can be driven at a low voltage. More specifically, electrodes are place din concave portions formed in at least one of an electrode substrate or a diaphragm substrate. Accordingly, the gap length is determined by the difference between the depth of each concave portion and the thickness of each electrode. The electrodes are formed by a diffusion layer in a silicon substrate. In this case, the gap length is determined by the thickness of an oxide film formed as a gap spacer.

Japanese Laid-Open Patent Application No. 9-193375 discloses an electrostatic ink jet head in which each gap between the diaphragm and electrodes facing the diaphragm has a non-parallel shape so as to restrict variations of the discharging amount and the discharging rate of ink droplets. Furthermore, the diaphragm and the individual electrodes facing the diaphragm are bonded via an insulating coating layer, so that a collision between the diaphragm ad the individual electrodes can be avoided. Each gap is formed between a step portion or a concave portion in the diaphragm substrate and a non-parallel step portion of the electrode substrate.

An ink jet head of an electrostatic actuator type in which the diaphragm is deformed by electrostatic force so as to generate pressure wave in an ink chamber can be produced by a wafer process. Accordingly, the ink jet head can have high density and a large number of stable devices can be produced. The ink jet head having a planar structure can be made smaller, as disclosed in Japanese Laid-Open Patent Application No. 7-125196 and others. The diaphragm is vibrated by electrostatic force caused by a voltage applied between the diaphragm and the individual electrodes and by the rigidity of the diaphragm. With the vibration of the diaphragm, ink is sucked in and discharged.

The pulling out of the individual electrodes disclosed in Japanese Laid-Open Patent Application 7-125196 is carried out on parts of the surface of the electrode substrate, with which neither liquid chamber nor diaphragm substrate is in contact. As disclosed in Japanese Patent Application Nos. 9-148062 and 10-61308, the individual electrodes are pulled out from the bottom side of the electrode substrate, so that the chip area and the number of mounting steps can be reduced.

As disclosed in Japanese Laid-Open Patent Application No. 7-125196 and Japanese Patent Application No. 9-148062, concave portions are formed in an insulating substrate, and electrodes made of a conductive material such as metal are placed in the respective concave portions, thereby obtaining the individual electrodes. As disclosed in Japanese Patent Application 10-61308, the individual electrodes may also be constituted by conductive impurity (dopant) diffusion regions formed in a silicon substrate.

The displacement ä(m) of the diaphragm of the electrostatic ink jet head is determined by the equation (1), and the electrostatic attraction P (N/m$^2$) is determined by the equation (2).

$$\ddot{a}=k\times 12(1-v^2)/Eh^3\times Pa^4 \quad (1)$$

P: electrostatic attraction (N/m$^2$)
a: short side length (m)
h: diaphragm thickness
v: Poisson's ratio
E: Young's modulus
k: constant $$P=\tfrac{1}{2}\times\mathring{a}\times(V/G_{eff})^2 \quad (2)$$

å: dielectric constant (F/m)
V: voltage (V)
$G_{eff}$: effective gap length (m)

In accordance with the above equations, the displacement of the diaphragm due to electrostatic force is inversely proportional to the square of the effective gap length $G_{eff}$. Therefore, it is important to form the gaps at high precision. Also, the effective gap length $G_{eff}$ needs to be made smaller so as to have a low driving voltage. In other words, it is necessary to form narrow gaps at high precision.

On the other hand, in the case where the individual electrodes are formed in the concave portion in an insulating substrate (or in an insulating film on a conductor or a semiconductor substrate), as disclosed in Japanese Laid-Open Patent Application No. 7-125196 and Japanese Patent Application No. 9-148062, the effective gap length $G_{eff}$ can be expressed as:

$$G_{eff}=(\text{concave depth}-\text{individual electrode thickness}) \quad (3)$$

In this equation, the passivation film or insulation film on the individual electrodes is no taken into consideration. As is apparent from the equation (3), the effective gap length $G_{eff}$ is influenced by both variations of the depth of the concave portions and the thickness of the individual electrodes. If the following relationship (4):

$$\text{concave depth}>\text{individual electrode thickness} \quad (4)$$

is satisfied, the effective gap length $G_{eff}$ is determined mainly by the concave depth, which is relatively controllable. If the effective gap length $G_{eff}$ is small, the relationship (4) can be satisfied, as long as the thickness of the individual electrodes is very small. However, there is a limit to the thinness of the individual electrodes, in terms of resistance and workability. If the effective gap length $G_{eff}$ is made smaller to obtain a lower voltage, the control of variation of the effective gap length $G_{eff}$ becomes difficult.

In the case where the individual electrodes are constituted by the impurity (dopant) diffusion region in the silicon substrate, the effective gap length $G_{eff}$ is determined only by the concave depth, and may be narrowed to obtain a lower voltage. However, this structure requires sophisticated and complicated production procedures so as to ensure high voltage resistance between the substrate and the electrodes and between adjacent electrodes, and to reduce leakage current. As a result, the production costs are increased, and a voltage of only one polarity can be applied to the individual electrodes.

In the case where the electrodes are formed on an insulating substrate or on an insulating film on a substrate, as in the disclosures of Japanese Laid-Open Patent Application Nos. 5-50601 and 6-71882, the gap length is the difference between the electrode thickness and the depth of the concave portions formed in the diaphragm substrate and/or the electrode substrate. If the gap length is great and the electrode thickness is smaller than the concave depth, the precision of the gap length is determined mainly by the precision of the concave depth. However, if the gap length is made smaller so as to obtain a lower voltage, the variation of the gap length becomes greater. It is of course possible to restrict the variation of the gap length by reducing the thickness of the electrodes. In such a case, however, the resistance of the electrodes becomes high, and the driving voltage cannot be increased.

Japanese Laid-Open Patent Application No. 6-71882 discloses the structure having electrodes formed by a diffusion layer in the silicon substrate. In this structure, the precision of the gap length is not lowered by the thickness of the electrodes. However, since the electrodes and the substrate is separated by pn junction, a voltage of only one polarity can be applied, the process of ensuring enough voltage resistance is complicated, and it is difficult to maintain the yield of the pn junction with the electrodes having relatively large areas. Also, each diaphragm chamber and its surrounding area are not completely sealed. Therefore, it is necessary to perform a sealing step using a sealing member to protect the ink jet head from foreign matter during an actual operation. Still, there is a possibility that foreign matter will enter the ink jet head prior to the sealing step during the production procedure.

Japanese Laid-Open Patent Application No. 9-193375 discloses a structure in which the diaphragm is bonded to a part of the individual electrodes via an insulating coating layer. However, the bonding is not made on a single plane. Therefore, it is necessary to adjust the irregular surfaces of both substrates at the time of bonding. Even after the adjustment of the bonding surfaces, there will be small gaps between the bonding surfaces, resulting in poor bonding strength. Moreover, Japanese Laid-Open Patent Application No. 9-193375 does not teach specific materials and methods for boding.

SUMMARY OF THE INVENTION

It is a general object of the present invention to provide ink jet heads and methods of producing the same, in which the above-mentioned problems are eliminated.

A more specific object of the present invention is to provide an electrostatic ink jet head in which the individual electrodes have high voltage resistivity, voltage of both polarities can be applied, and gap formation can be carried out with high precision through simpler production steps.

Another specific object of the present invention is to provide an electrostatic ink jet head in which the diaphragm and the electrode substrate are bonded to each other on the same plane, and the individual electrodes are bonded to the diaphragm via an insulating layer. With this structure, even if the gap length is short, the precision in gap formation can be high.

Further specific object of the present invention is to provide an electrostatic ink jet head in which the diaphragm is combined with the individual electrodes and the common electrode, so that the entire structure and the production steps can be dramatically simplified.

The above objects of the present invention are achieved by an electrostatic ink jet head, comprising: a plurality of nozzles through which ink droplets are discharged; a plurality of ink passages that communicate with the nozzles; a diaphragm that forms a part of each of the ink passages and has a common electrode; a plurality of individual electrodes that face the diaphragm; and spacers, each of which maintains a gap between the diaphragm and each of the individual electrodes. In this electrostatic ink jet head, a driving voltage is applied between the common electrode and the individual electrodes, so that the diaphragm is deformed by electrostatic force to pressurize ink in the ink passages. Also, in this electrostatic ink jet head, at least a part of the spacer is made of the same material as the individual electrodes.

Since the diaphragm and at least a part of the spacer that forms the gap between the diaphragm and each individual electrode is made of the same material as the individual electrodes, the gap formation can be carried out at high precision.

In the above electrostatic ink jet head of the present invention, the individual electrodes and a part of the spacer are made of monocrystal silicon, and the remaining part of the spacer is formed from silicon oxide film. With this structure, the gap formation can be carried out at higher precision.

The above electrostatic ink jet head of the present invention further comprises: an electrode supporting substrate that supports the individual electrodes; through holes, each of which penetrates through the electrode supporting substrate from a bottom side surface thereof to each corresponding individual electrode; and electrode retrieve pads formed on the bottom side surface of the electrode supporting substrate. With this structure, the chip size and the cost for packaging can be reduced.

In the above electrostatic ink jet head of the present invention, the electrode supporting electrode is a <110> silicon substrate, and a surface of each of the through holes has a (111) plane. With this structure, high-density through hole formation can be carried out at high precision.

In the above electrostatic ink jet head of the present invention, the electrode supporting substrate is a silicon substrate that has a higher dopant concentration than that of the individual electrodes. With this structure, the oxidation speed is increased due to the impurities, and because of that, the through hole formation can be easily carried out at high precision.

The above objects of the present invention are also achieved by a method of producing an electrostatic ink jet head that comprises: a plurality of nozzles through which ink droplets are discharged; a plurality of ink passages that communicate with the nozzles; a diaphragm that forms a part of each of the ink passages and has a common electrode; a plurality of individual electrodes that face the diaphragm; and spacers, each of which maintains a gap between the diaphragm and each of the individual electrodes, the diaphragm being deformed by electrostatic force to pressurize ink in the ink passages. This method comprises the steps of: oxidizing an SOI substrate that is used as an electrode supporting substrate; performing etching on a part of a resultant oxide film; and performing etching to form a separation groove between each of the individual electrodes and each corresponding one of the spacers.

In accordance with this method of the present invention, the regular semiconductor production processes can be applied to the production of the electrostatic ink jet head. Thus, a highly reliable electrostatic ink jet head can be produced at high precision and at low costs.

The above method of the present invention further comprises the step of forming through holes after the formation of a material to be the individual electrodes on the electrode supporting substrate. With this method, the individual electrodes can be prevented from having through holes, thereby allowing more freedom in design.

The above objects of the present invention are also achieved by an ink jet head that discharges ink droplets through nozzles by deforming a diaphragm by electrostatic force caused by a driving voltage applied between a common electrode formed on the diaphragm and individual electrodes. This ink jet head comprises: a liquid chamber substrate provided with the diaphragm that forms a part of each of liquid chambers communicating with the nozzles; an electrode substrate having the individual electrodes facing the diaphragm via a gap. In this ink jet head, the liquid chamber substrate and the electrode substrate are bonded to each other on the same plane, with an insulating layer being interposed therebetween.

With the above structure, the gap formation can be carried out at high precision.

In the above ink jet head, the liquid chamber substrate and the electrode substrate are both made of monocrystal silicon, and the insulating layer interposed between the liquid chamber substrate and the electrode substrate is formed from silicon oxide film.

With this structure, less deformation is caused at the time of bonding, and the bonding region between the diaphragm and the electrode substrate has higher rigidity. Thus, the ink jet head having high-precision gaps can be obtained. Also, the silicon oxide film is generally used for interlayer insulating film of semiconductors.

In the above ink jet head, each of the individual electrodes is taken out with a pad on the opposite surface from the liquid chamber substrate in a bonding region between the liquid chamber substrate and the electrode substrate. With this structure, the area for taking out the individual electrodes can be reduced, and the chip size can be reduced accordingly. Thus, more freedom is allowed in packaging, and the packaging procedure can be simplified. Furthermore, the production costs can be reduced.

The above objects of the present invention are also achieved by an ink jet head comprising: a plurality of nozzles through which ink droplets are discharged; a plurality of liquid chambers that respectively communicate with the plurality of nozzles; a diaphragm that is made of a conductive material and forms at least a part of each of the liquid chambers; a first substrate that includes the liquid chambers and the diaphragm; and a second substrate that has electrodes facing the diaphragm. In this ink jet head, the ink droplets are discharged through the nozzles by deforming the diaphragm with electrostatic force generated by a voltage applied between the diaphragm and an electrode facing the diaphragm via a gap; a part of the diaphragm made of a conductive material is electrically separated from each of the nozzles; the electrode facing the diaphragm serves as a common electrode; and the first substrate and the second substrate are bonded to each other on the same single plane, with an insulating layer being interposed therebetween.

With this structure, an ink jet head having high reliability, high bonding strength, and high-precision gaps, can be obtained.

In the above ink jet heat, the second substrate is made of a conductive material, and serves as the common electrode. Because of this, the entire structure can be simplified, and the number of production steps can be reduced. Thus, an ink jet head can be obtained at lower costs.

In the above ink jet head, the first substrate and the second substrate are bonded to each other, with a silicon oxide film being interposed therebetween. At least one of the diaphragm and the common electrode may be made of monocrystal silicon. The first substrate may an SOI (Silicon on Insulator) substrate; at least a part of the diaphragm may be made of monocrystal silicon; the second substrate may be a monocrystal silicon substrate; and the first substrate and the second substrate are bonded to each other, with a silicon oxide film being interposed therebetween.

With the above structure, direction bonding between silicon oxide films or between a silicon oxide film and a silicon material can be performed to bond the diaphragm or the diaphragm material to the individual electrodes or the individual electrode material. Thus, an ink jet head having high-precision gaps can be obtained.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1A:
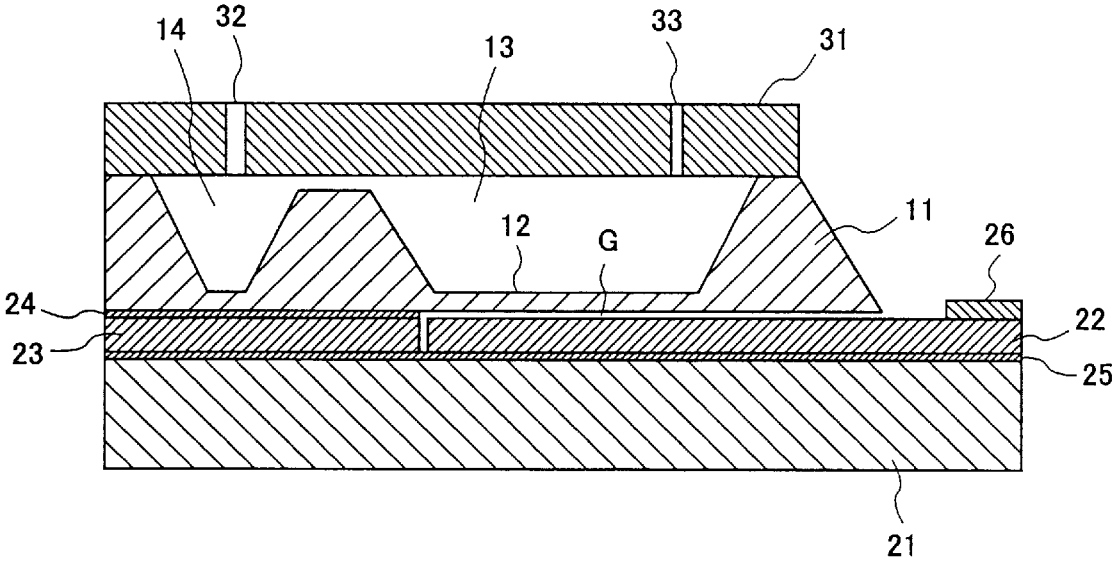
FIGS. 1A and 1B illustrate an embodiment of an electrostatic ink jet head of the present invention.
Figure 1B:
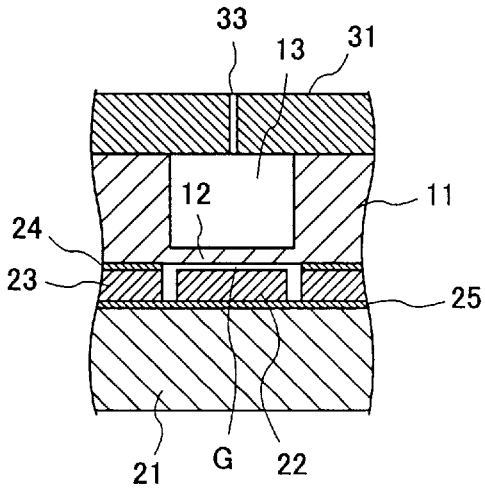

FIGS. 1A and 1B show an embodiment of an electrostatic ink jet head of the present invention. FIG. 1A is a longitudinal-direction sectional view of one individual bit of the electrostatic ink jet head, and FIG. 1B is a transverse-direction sectional view of the same. In FIGS. 1A and 1B, reference numeral 11 indicates a liquid chamber diaphragm substrate that has a diaphragm 12, an ink pressure chamber 13, and a common ink chamber 14 formed thereon. The liquid chamber diaphragm substrate 11 is formed from a <110> silicon wafer which is processed to form the ink pressure chamber 13 and also to form the diaphragm 12 at the bottom. An electrode substrate 21 formed from a <100> silicon wafer serves to support electrodes, and an insulating film 25 made of silicon oxide film having a thickness of approximately 1 $\mu$m is formed on the electrode substrate 21. An individual electrode 22 made of monocrystal silicon is formed on the insulating film 25, with a 0.5 $\mu$m gap G being interposed between the individual electrode 22 and the diaphragm 12. The gap G (or a diaphragm chamber) is maintained by a first gap spacer 23 made of monocrystal silicon having the same thickness as the individual electrode 22, and a second gap spacer 24 formed on the first gap spacer 23 and made of silicon oxide film having a thickness of 0.5 $\mu$m. As in the prior art, this ink jet head also comprises a nozzle plate 31 having an ink supply hole 32 and nozzle holes 33. The individual electrode is taken out by performing wire bonding on a metal pad 26 formed on an area in which the liquid chamber diaphragm substrate 11 does not exist.

As will be apparent from the production method described later, the first gap spacer 23 and the individual electrode 22 are formed by dividing a single material, so that the thicknesses of the first gap spacer 23 and the individual electrode 22 can be exactly the same thickness. Accordingly, the narrow gap G between the diaphragm 12 and the individual electrode 22 is defined only by the thickness of the second gap spacer 24, thereby achieving high-precision gap formation. Further, the second gap spacer 24 is made of silicon oxide film formed through thermal oxidation, so that the gap formation becomes even more precise.

Although not shown in the drawings, an insulating film such as a silicon oxide film is formed on the individual electrode, so as to prevent short-circuiting due to rare contact between the diaphragm 12 and the individual electrode 22. In a case where the oxide film formed by subjecting the individual electrode 22 to thermal oxidation, there will be a difference in thickness between the individual electrode 22 and the first gap spacer 23 by the thickness of the oxide film. However, the thickness of the oxide film can be controlled with high precision, so that the thickness value can be taken into account in advance. Thus, there will be little adverse influence on the gap G.

FIGS. 2A to 2F illustrate the procedure of producing the electrostatic ink jet head shown in FIGS. 1A and 1B.

Figure 2A:
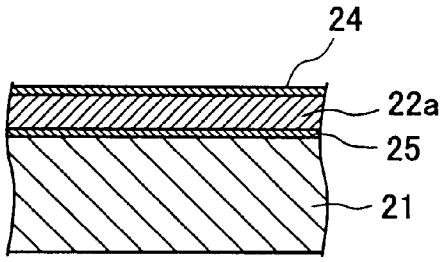
FIGS. 2A to 2F illustrate the procedure of producing the electrostatic ink jet head of FIGS. 1A and 1B.

Step (a): The electrode substrate 21 is formed from a <100> silicon having a thickness of approximately 600 $\mu$m, and sandwiches the insulating film 25 with an SOI (Silicon On Insulator) substrate that serves as an electrode forming substrate having a 5 $\mu$m thick monocrystal silicon layer (single layer) 22*a*. The thermal oxide film (insulating film) 24 having a thickness of 0.5 $\mu$m is then formed on the monocrystal silicon layer 22*a*, as shown in FIG. 2A.

Figure 2B:
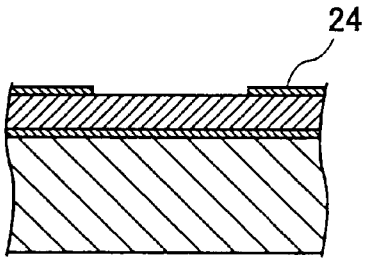

Step (b): The thermal oxide film 24 formed in Step (1) is subjected to photolithography etching, so as to produce holes at predetermined locations in the thermal oxide film 24. The remaining part of the thermal oxide film 24 without the holes forms the second gap spacer 24, as shown in FIG. 2B.

Figure 2C:
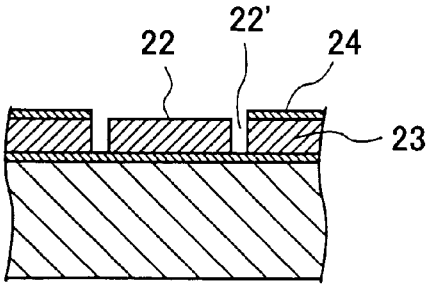

Step (c): The monocrystal silicon layer 22*a* is subjected to photolithography etching, so as to form separating grooves 22'. The separating grooves 22' divide the monocrystal silicon layer 22*a* into the individual electrodes 22 and the first gap spacer 23, as shown in FIG. 2C.

The following steps are the same as in the prior art.

Figure 2D:
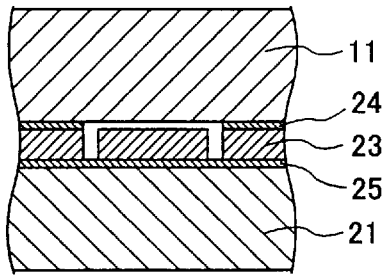

Step (d): The liquid chamber diaphragm substrate 11 formed from a <110> monocrystal silicon wafer is bonded, by a direct bonding technique, onto the electrode substrate having the gap and individual electrodes formed in steps (a) to (c), as shown in FIG. 2D.

Figure 2E:
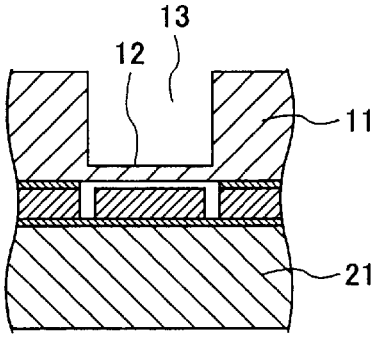
Figure 2F:
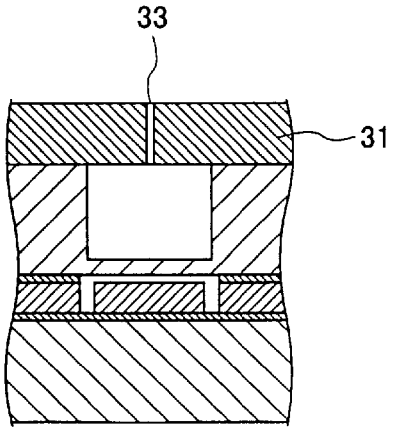

Step (e): The ink pressure chamber 13 and the diaphragm 12 are formed by a silicon anisotropic etching technique using a KOH (potassium hydroxide) solution, as shown in FIG. 2E.

Step (f): The nozzle plate 31 having the nozzle holes 33 and the ink supply hole 32 is bonded to cover the ink pressure chamber 13.

The above steps are followed by dicing and mounting, thereby forming the electrostatic ink jet head. In this embodiment, a silicon substrate is used as the electrode substrate, a silicon oxide film is used as the insulating film, and monocrystal silicon is used for the individual electrodes. However, other materials can be of course employed in the present invention.

Figure 3A:
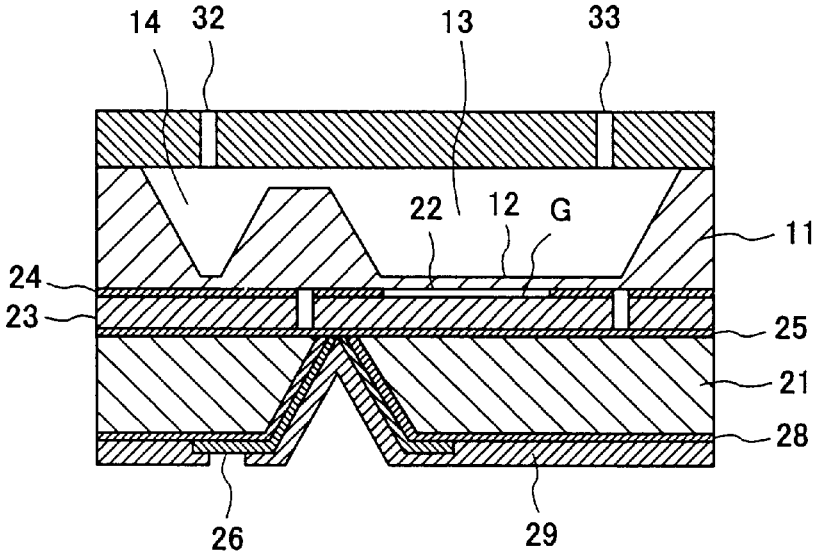
FIGS. 3A and 3B illustrate another embodiment of the electrostatic ink jet head of the present invention.
Figure 3B:
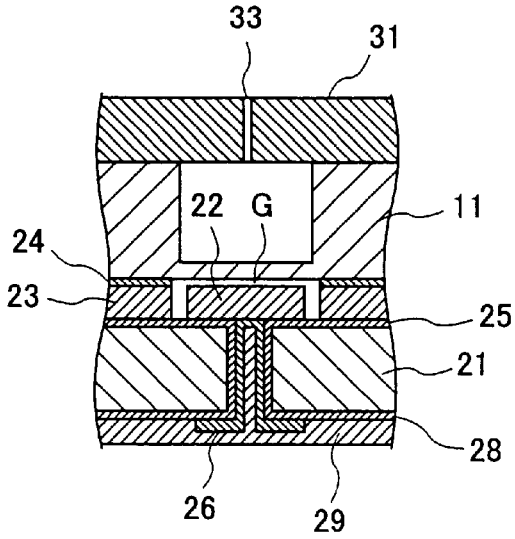

FIGS. 3A and 3B show another embodiment of the electrostatic ink jet head of the present invention. FIG. 3A is a longitudinal-direction sectional view of one individual bit of this ink jet head, and FIG. 3B is a vertical-direction sectional view of the same. In FIGS. 3A and 3B, the liquid chamber diaphragm substrate 11 is formed from a <110> silicon wafer, for instance. The silicon wafer is processed to form the ink pressure chamber 13, and also to form the diaphragm 12 having a thickness of 5 $\mu$m at the bottom. As in the embodiment shown in FIGS. 1A and 1B, the electrode substrate formed from a <100> silicon wafer serves as an electrode substrate, and the insulating film 25 formed of silicon oxide film having a thickness of approximately 1 $\mu$m. The individual electrode 22 made of monocrystal silicon is formed on the insulating film 25, and faces the diaphragm 12, with a 0.5 $\mu$m wide gap G being formed between the individual electrode 22 and the diaphragm 12. The narrow gap G is maintained by the first gap spacer 23 made of monocrystal silicon having the same thickness as the individual electrode 22, and by the second gap spacer 24 formed from silicon oxide film having a thickness of 0.5 $\mu$m on the first gap spacer 23. As in the prior art, the ink jet head also comprises the nozzle plate having the nozzle holes 33 and others. As illustrated in FIGS. 4A to 4E, a through hole is formed at a location in the electrode substrate 21 which conforms to the location of the individual electrode 22, and the individual electrode 22 is taken out from the lower side of the electrode substrate 21 using the metal pad. With this structure, the chip size and the cost for packaging can be reduced.

FIGS. 4A to 4E illustrate the procedure of producing the electrostatic ink jet head shown in FIGS. 3A and 3B.

Figure 4A:
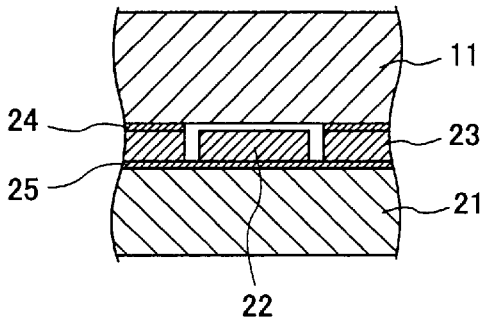
FIGS. 4A to 4E illustrate the procedure of producing the electrostatic ink jet head of FIGS. 3A and 3B.

Step (a): The same steps (a) to (c) as in the embodiment shown in FIGS. 1A and 1B are performed, that is, the step of forming the thermal oxide film 24 having a thickness of 0.5 $\mu$m on the SOI substrate as the electrode forming substrate having the 5 $\mu$m monocrystal silicon layer 22*a*, which sandwiches the thermal oxide film 25 having the thickness of 1.0 $\mu$m with the electrode substrate 21 made of <110> silicon having a thickness of approximately 400 $\mu$m (FIG. 2A); the step of subjecting the thermal oxide film 24 to photolithography etching so as to form holes at a predetermined location in the thermal oxide film 24 (FIG. 2B); and subjecting the monocrystal silicon layer 22*a* to photolithography etching so as to form the separating grooves 22' at predetermined locations in the monocrystal silicon layer 22' (FIG. 2C), are performed. The electrode substrate 21 having the gap G and the individual electrode 22 is then bonded to the liquid chamber diaphragm substrate 11 formed from the <110> monocrystal silicon wafer by a direct bonding technique, as shown in FIG. 4A. Up to this step (FIG. 4A), the processes are the same as in FIGS. 2A to 2D, except that the electrode substrate 21 has the thickness of 400 $\mu$m, and is formed from the <110> silicon wafer. Depending on the nozzle pitch, it is of course possible to form the electrode substrate 21 from a <100> silicon wafer having a thickness of approximately 600 $\mu$m, as in the embodiment shown in FIGS. 1A and 1B.

Figure 4B:
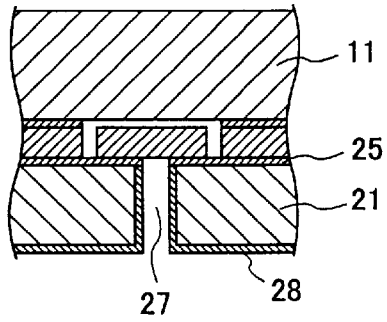

Step (b): A though hole 27 is formed at a location in the electrode substrate 21 which conform to the location of the individual electrode 22. The through hole 27 also penetrates through the insulating film 25. A thermal oxide film is then formed as an insulating film 28 on the inner surfaces of the through hole 27 and on the bottom surface of the electrode substrate 21, as shown in FIG. 4B. As for the technique used in this step, a silicon substrate having higher-concentration impurity (dopant) diffusion than the individual electrode 22 is used as the electrode substrate 21. Alternatively, after the formation of the through hole 27, impurity (dopant) diffusion is performed on the surface of the through hole 27, and thermal oxidation is then carried out, so that the resultant oxide film is thicker on the surface of the through hole and on the bottom surface of the electrode substrate 21 than on the bottom surface of the individual electrode 22. Etching is then performed on the oxide film so as to remove the part of the oxide film formed on the bottom surface of the individual electrode, as shown in FIG. 4B.

Conventionally, individual electrodes could not be made thick. Because of that, after the through hole 27 is formed, a hole is automatically formed in the individual electrode in the following steps. In the present invention, on the other hand, the gap precision does not depend on the thickness of the individual electrode, and the individual electrode can be made thick to attain enough strength. Also, even if there is a through hole penetrating through the electrode substrate 21, the individual electrode 22 covers the through hole, thereby preventing air leak at the time of vacuum chucking. Accordingly, automated production of the ink jet head can be easily realized.

Figure 4C:
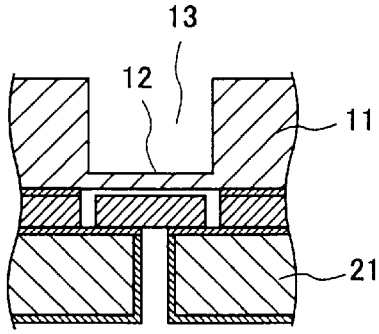

Step (c): The liquid chamber diaphragm substrate 11 is subjected to silicon anisotropic etching using a KOH solution or the like, thereby forming the ink pressure chamber 13 and the diaphragm 12, as shown in FIG. 4C. This step (c) can be performed at the same time as the through hole formation of step (b), so as to reduce the number of steps to be performed.

Figure 4D:
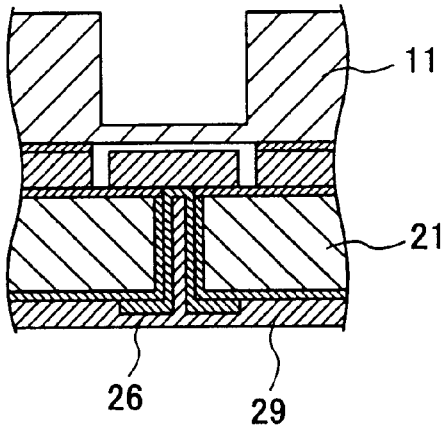

Step (d): Mask deposition is performed on the inner surface of the through hole 27 and the bottom surface of the individual electrode 22 by vacuum evaporation, so as to form the metal pad 26 made of aluminum or gold. A passivation film 29 that is laminated films including oxide film and nitride film formed by plasma CVD (Chemical Vapor Deposition) is formed on the metal pad 26, as shown in FIG. 4D. This step may be performed prior to the formation of the liquid chamber diaphragm 11 in step (c).

Figure 4E:
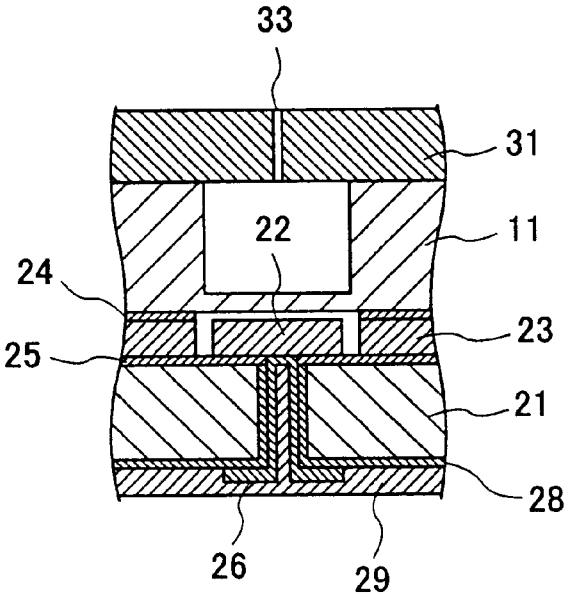

Step (e): The nozzle plate 31 is attached as shown in FIG. 4E.

The above steps (a) to (e) are followed by dicing and packaging, as in the prior art, thereby completing the ink jet head.

Figure 5A:
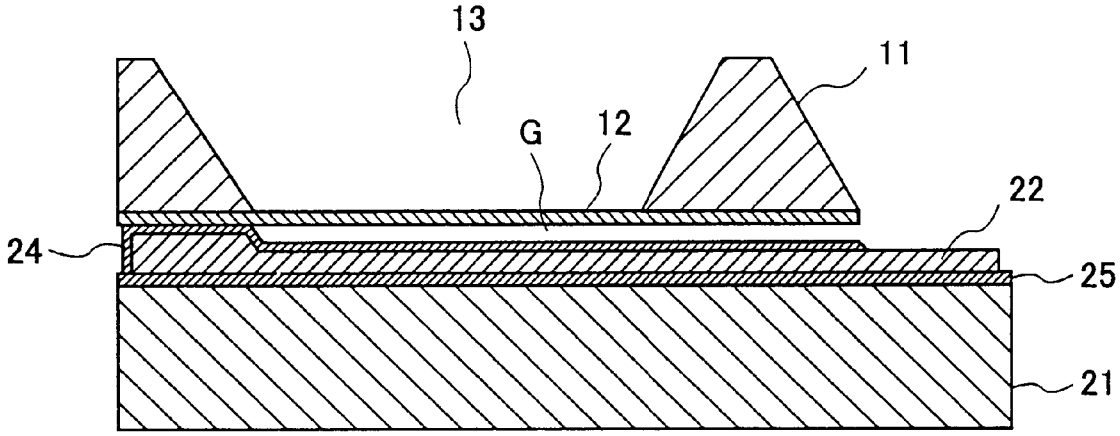
FIGS. 5A and 5B illustrate yet another embodiment of the electrostatic ink jet head of the present invention.
Figure 5B:
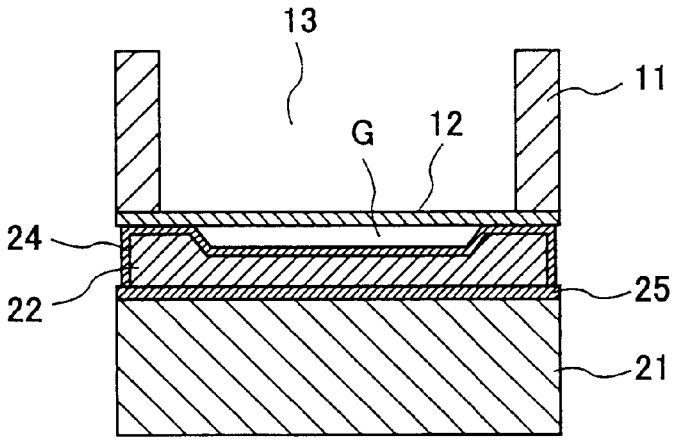

FIGS. 5A and 5B illustrate yet another embodiment of the electrostatic ink jet head of the present invention. FIG. 5A is a longitudinal-direction sectional view of one individual bit of the electrostatic ink jet head, and FIG. 5B is a transverse-direction sectional view of the same. The structure of this embodiment is basically the same as the embodiment described above, except the individual electrode 22 is made of monocrystal silicon, and the gap (diaphragm chamber) G is a concave portion formed in the individual electrode 22. In this embodiment, the diaphragm 12 and the individual electrode 22 are both made of monocrystal silicon, and the insulating film 24 is a thermal oxide film formed by carrying out thermal oxidation on monocrystal silicon. Accordingly, it is possible to perform direct bonding, and an ink jet head having high gap precision, high bonding strength, and high reliability, can be obtained.

FIGS. 6A to 6F illustrate the procedure of producing the electrostatic ink jet head shown in FIGS. 5A and 5B.

Figure 6A:
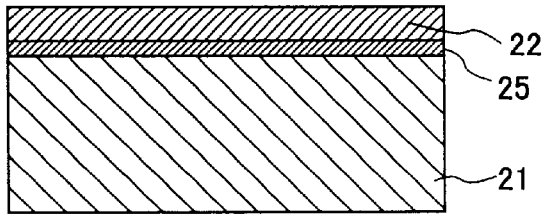
FIGS. 6A to 6F illustrate the procedure of producing the electrostatic ink jet head shown in FIGS. 5A and 5B.

Step (a): An SOI wafer having a 3.0 $\mu$m thick monocrystal silicon layer to be the individual electrode 22 is formed on a 625 $\mu$m thick <100> silicon wafer to be the electrode substrate 21 via the 1.0 $\mu$m thick thermal oxide film 25 that is the insulating film, as shown in FIG. 6A. Here, the SOI substrate is a commercially available laminated SOI wafer.

Figure 6B:
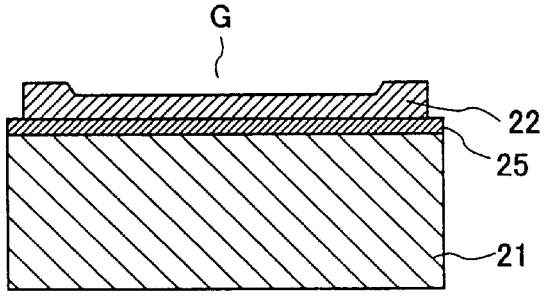

Step (b): The gap G (diaphragm chamber) having a depth of 0.2 $\mu$m is formed by photolithography etching, which is normally used in semiconductor production procedures, at a predetermined location in the monocrystal silicon layer of the individual electrode 22. The individual electrode 22 is then separated also by photolithography etching, as shown in FIG. 6B. The separation of the individual electrode 22 may be performed prior to the formation of the gap G. However, taking into account unevenness application and removal of resist, it is preferable to carry out the separation of the individual electrode 22, which requires relatively deep etching, after the formation of the gap G.

Figure 6C:
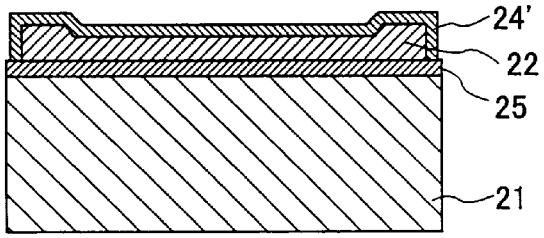

Step (c): A thermal oxide film 24' having a thickness of approximately 2000 Å is formed on the SOI substrate having the gap G and separated into the individual electrode 22, as shown in FIG. 6C.

Step (d): The thermal oxide film 24' formed in step (c) is removed by buffered hydrofluoric acid, as shown in FIG. 6D.

Step (e): A thermal oxide film having a thickness of 2000 Å is formed to obtain the insulating film 24, as shown in FIG. 6E.

Step (f): A <110> silicon wafer (i.e., the liquid chamber diaphragm substrate 11) having boron diffused at 5E19 cm−3 or more at the location to form the diaphragm 12 is bonded to the individual electrode 22 via the insulating film 24, as shown in FIG. 6F. In this embodiment, the diaphragm 12 and the individual electrode 22 are both made of monocrystal silicon, and the insulating film 24 is the thermal oxide film formed by subjecting monocrystal silicon to thermal oxidation. Accordingly, direction bonding, which is used in the formation of a laminated SOI wafer, can be employed to bond the diaphragm substrate 11 and the individual electrode 22.

Figure 6D:
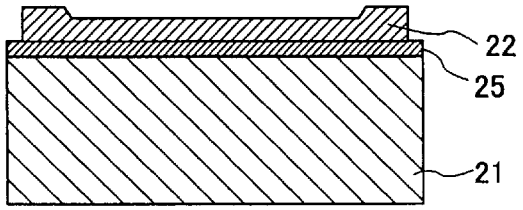
Figure 6E:
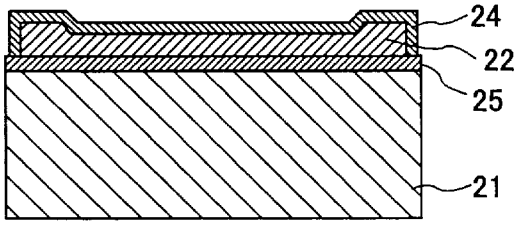
Figure 6F:
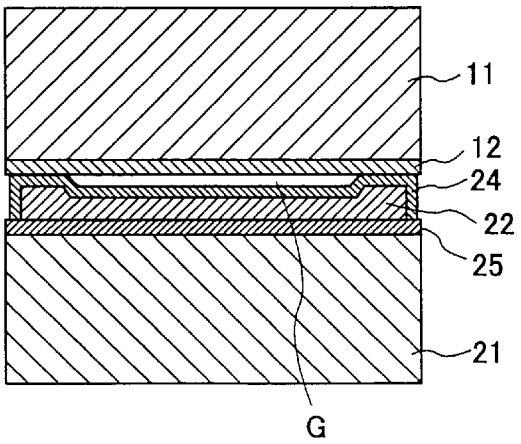

In the steps shown in FIGS. 6C to 6E, the individual electrode 22, which is a monocrystal silicon layer, is subjected to thermal oxidation to form the thermal oxide film 24' (FIG. 6C), the thermal oxide film 24' is then removed (FIG. 6D), and thermal oxidation is performed again to form the thermal oxide film 24 (FIG. 6E). In a case where the step portions formed by the individual electrode 22 in step (b), minute protrusions appear at the time of thermal oxidation. The direction bonding cannot be effectively carried out with the minute protrusions, resulting in poor bonding strength. To avoid such a problem, thermal oxidation is performed in step (c), and the resultant thermal oxide film is removed so as to round the step portions in step (d). After that, thermal oxidation is again performed, thereby achieving high bonding strength.

Figure 7:
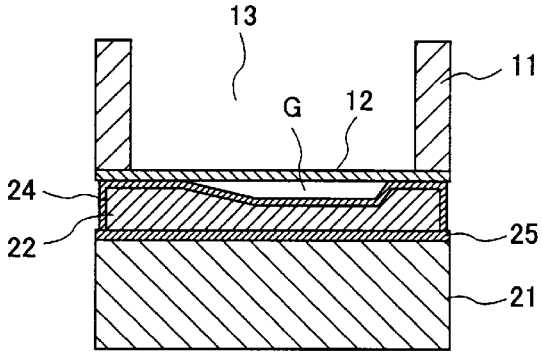
FIG. 7 illustrates a modification of the electrostatic ink jet head shown in FIGS. 5A and 5B.

FIG. 7 is a vertical-direction sectional view of a modification of the electrostatic ink jet head shown in FIGS. 5A and 5B. This modification is basically the same as the embodiment described above, except that the gap (diaphragm chamber) G has a non-parallel configuration so as to obtain a lower driving voltage and multi-gradation, and to avoid collision between the diaphragm 12 and the individual electrode 22. The procedure of producing the ink jet head of this embodiment is also the same as the production procedure of the embodiment described above, except for the step of forming the gap G in the individual electrode 22. In this embodiment, after a non-parallel gap is formed in a resist using a mask having continuously variable permeability, the resist and the individual electrode 22 are etched at the same time, so that the non-parallel gap configuration formed in the resist is transferred to the individual electrode 22.

Figure 8A:
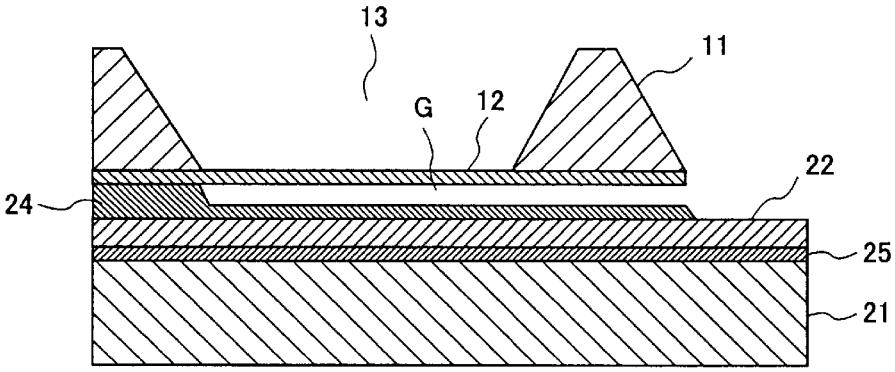
FIGS. 8A and 8B illustrate yet another embodiment of the electrostatic ink jet head of the present invention.
Figure 8B:
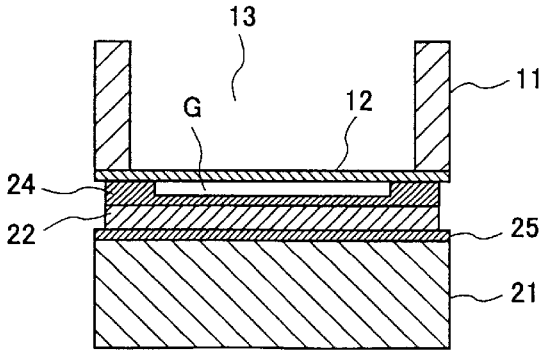

FIGS. 8A and 8B illustrate yet another embodiment of the electrostatic ink jet head of the present invention. FIG. 8A is a longitudinal-direction sectional view of one individual bit of this ink jet head, and FIG. 8B is a transverse-direction sectional view of the same. This embodiment is basically the same as the embodiment described above, except that the formation of the gap (diaphragm chamber) G is obtained by forming a concave portion in the insulating film 24 on the individual electrode 22. In this embodiment, the insulating film 24 in the bonding region between the diaphragm 12 and the individual electrode 22 is thick enough to accommodate a high driving voltage. The diaphragm 12 and the individual electrode 22 are both made of monocrystal silicon, and the insulating film 24 is formed from thermal oxide film, so that the silicon direct bonding can be performed.

FIGS. 9A to 9D illustrate a part of the procedure of producing the electrostatic ink jet head shown in FIGS. 8A and 8B.

Figure 9A:
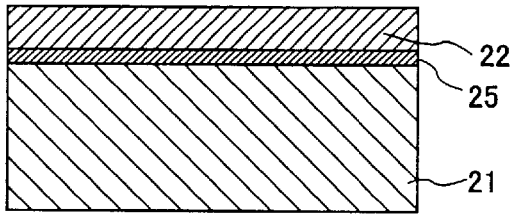
FIGS. 9A to 9D illustrate a part of the procedure of producing the electrostatic ink jet head shown in FIGS. 8A and 8B.
Figure 9B:
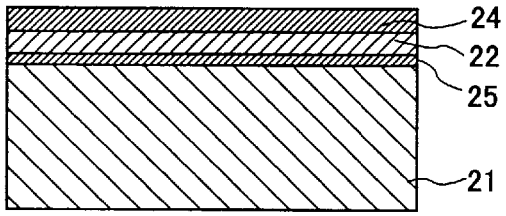

Step (a): The individual electrode 22 is formed from monocrystal silicon, such as a commercially available SOI wafer, as shown in FIG. 9A.

Step (b): The monocrystal silicon used for the individual electrode 22 is then subjected to thermal oxidation, so as to form the insulating film 24, as show in FIG. 9B. In this embodiment, the insulating film 24 has a thickness of approximately 4000 Å.

Figure 9C:
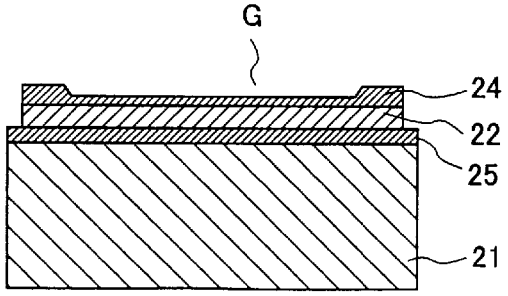

Step (c): The gap (diaphragm chamber) G having a depth of 0.2 $\mu$m is formed by photolithography etching, which is used in semiconductor production procedures, in the insulating film 24, as shown in FIG. 9C. The insulating film 24 and the individual electrode 22 are then separated also by photolithography etching. The separation of the insulating film 24 and the individual electrode 22 may be carried out prior to the formation of the gap G. However, taking into account unevenness application and removal of the resist, it is preferable to carry out the separation of the individual electrode 22, which requires relatively deep etching, after the formation of the gap G.

Figure 9D:
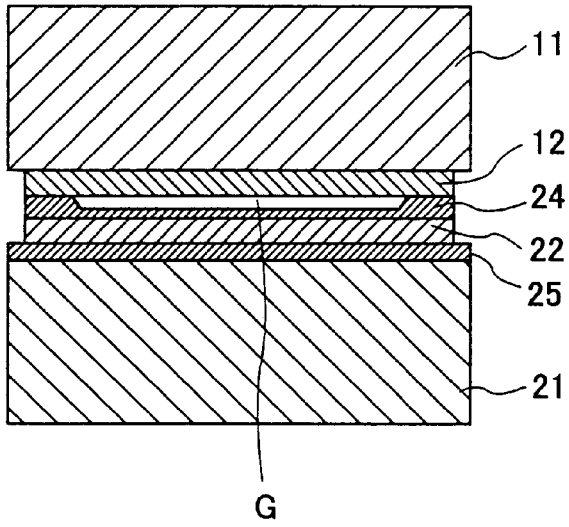

Step (d): A <110> silicon wafer (i.e., the liquid chamber diaphragm substrate 11) having boron diffused at 5E19 cm−3 or more at the location to form the diaphragm 12 is bonded to the individual electrode 22 via the insulating film 24, as shown in FIG. 9D. In this embodiment, the individual electrode 22 is made of monocrystal silicon, and the insulating film 24 is a thermal oxide film. Accordingly, direction bonding can be employed to bond the diaphragm substrate 11 and the individual electrode 22.

Figure 10:
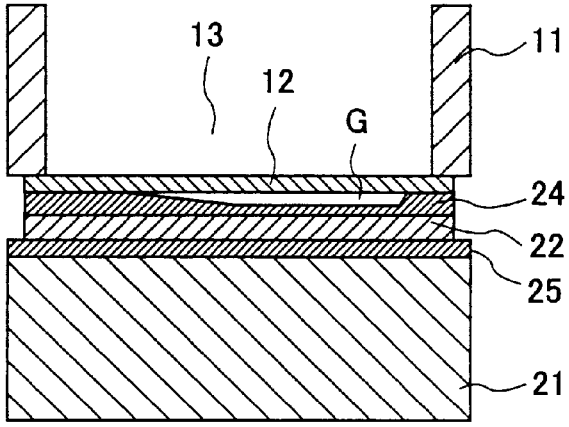
FIG. 10 shows a modification of the electrostatic ink jet head shown in FIGS. 8A and 8B.

FIG. 10 is a transverse-direction sectional view of a modification of the electrostatic ink jet head shown in FIGS. 8A and 8B. The structure of this modification is basically the same as the ink jet head shown in FIGS. 8A and 8B, except that the gap G formed in the insulating film 24 has a non-parallel configuration to obtain a lower driving voltage and multi-gradation, and to avoid collision between the diaphragm 12 and the individual electrode 22. The production procedure is also the same as in the procedure shown in FIGS. 9A to 9D, except for the step of forming the gap G in the insulating film 24. In this embodiment, after a non-parallel gap is formed in a resist using a mask having continuously variable permeability, the resist and the insulating film 24 are etched at the same time, so that the non-parallel gap configuration formed in the resist is transferred to the insulating film 24.

Figure 11A:
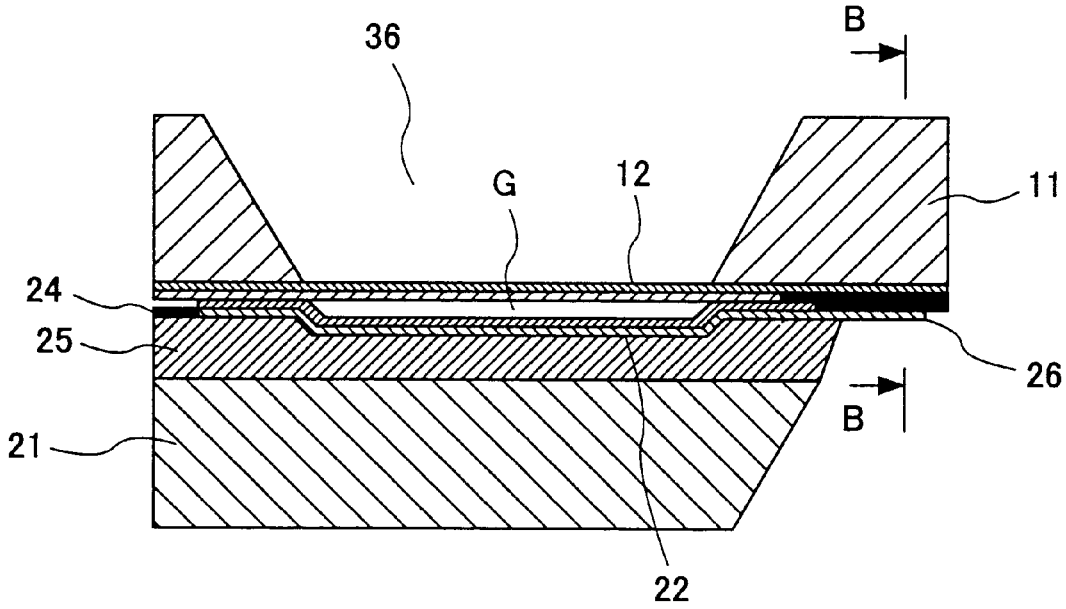
FIGS. 11A and 11B illustrate a further embodiment of the electrostatic ink jet head of the present invention.
Figure 11B:
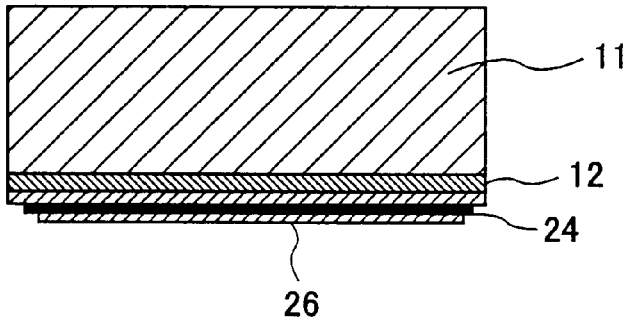

FIGS. 11A and 11B illustrate yet another embodiment of the electrostatic ink jet head of the present invention. FIG. 11A is a longitudinal-direction sectional view of one individual bit of this electrostatic ink jet head, and FIG. 11B is a transverse-direction sectional view of the same. In this embodiment, the liquid chamber diaphragm substrate 11 is taken out in the opposite direction from the diaphragm 12 at the separation wall of the liquid chamber diaphragm substrate 11. Such a structure can be easily attained, because the diaphragm 12 and the individual electrode 22 are bonded to each other via the insulating film 24. Also, since the area of the metal pad 26 can be limited, the chip size can be reduced, and more freedom will be allowed in design. Thus, the packaging process can be simplified.

Figure 12A:
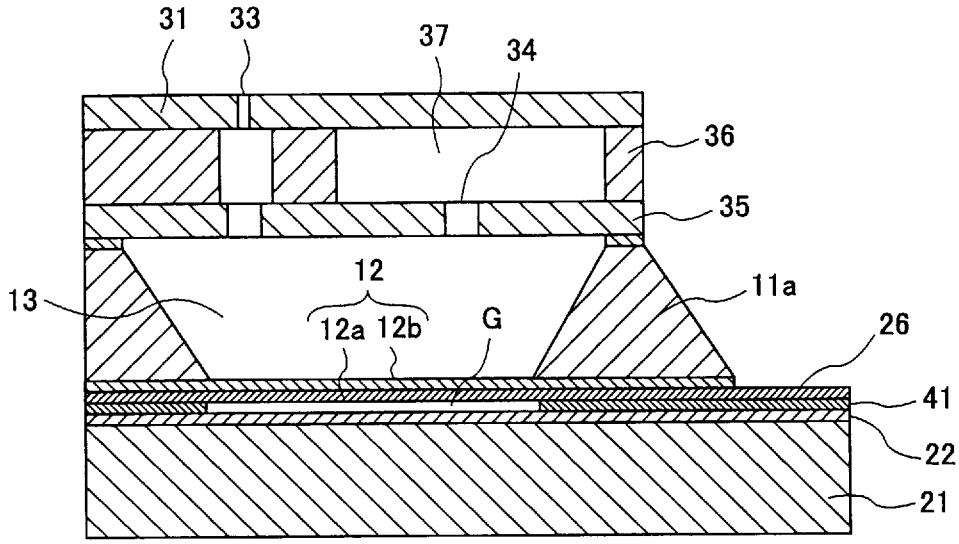
FIGS. 12A and 12B illustrate another embodiment of the electrostatic ink jet head of the present invention.
Figure 12B:
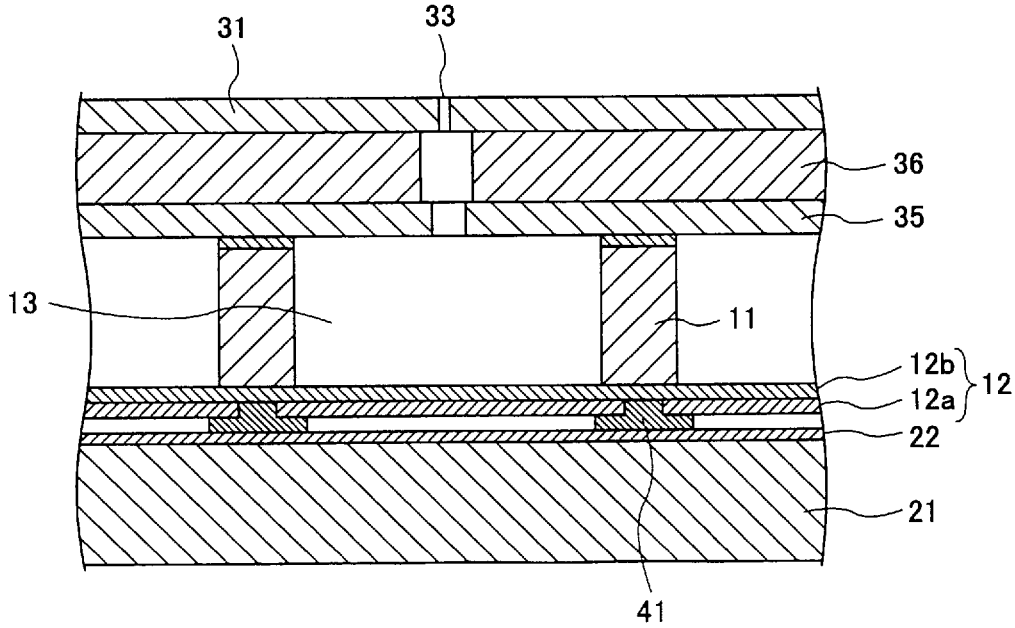

FIGS. 12A and 12B illustrate still another embodiment of the electrostatic ink jet head of the present invention. FIG. 12A is a longitudinal-direction sectional view of one individual bit of this ink jet head, and FIG. 12B is a transverse-direction sectional view of the same. The electrostatic ink jet head of this embodiment comprises a first substrate (or the liquid chamber diaphragm substrate) 11 having a separation wall 11*a,* the diaphragm 12 (12*a* and 12*b*), and the ink pressure chamber 13, a second substrate (or the electrode substrate) 21 having the individual electrode 22 and the insulating film 24, the nozzle plate 31 having nozzle holes 33, a fluid resistance plate 35 having a fluid resistance 34, a separation wall 36, and a common liquid chamber 37. The narrow gap G is formed between the diaphragm 12 and the individual electrode 22. When an electric voltage is applied between the diaphragm 12 and the individual electrode 22, the diaphragm 12 is moved toward the individual electrode 22 due to the electrostatic force caused between the electrodes. As a result, ink is supplied from the common liquid chamber 37 to the ink pressure chamber 13 through the fluid resistance 34. When the voltage supplied is stopped, the moved diaphragm 12 elastically returns to its original position, thereby discharging the ink through the nozzle holes 33.

As shown in FIG. 12, the common liquid chamber 37 is surrounded by the fluid resistance plate 35, the nozzle plate 31, and the separation wall 36 that also serves as a bonding layer for the liquid resistance plate 35 and the nozzle plate 31. Although the fluid resistance 34 is formed by an opening through the fluid resistance plate 35, this is merely an example, and it is possible to form the fluid resistance 34 in the diaphragm substrate 11 on which the diaphragm 12 is formed. Also, the nozzle 33 is formed by an opening through the nozzle plate 31, and the ink discharging direction through the nozzle 33 is perpendicular to the diaphragm substrate 11. However, the nozzle 33 may also be formed by a groove in the diaphragm substrate 11, and the ink may be discharged toward the edge of the diaphragm substrate 11.

An ink jet head generally has a plurality of nozzles, and controls each of the nozzles discharging ink for printing. To control the ink discharge from each nozzle independently of one another, at least either the diaphragm electrodes or the individual electrodes are assigned to the respective nozzles, and potential control is performed independently on each of the electrodes. In this embodiment, however, the potential of the diaphragm corresponding to each nozzle is independently controlled, and the electrode 22 facing the diaphragm via the gap G can constitute a common electrode. In this structure, the diaphragm 12 preferably comprises conductive portions 12*a* that form diaphragm electrodes to which the potential of the diaphragm is applied, and insulating portions 12*b* that serve as insulators against ink. In a case where conductive ink is used, it is necessary to include the conductive portions 12*a* and the insulating portions 12*b*. For the sake of convenience, both portions 12*a* and 12*b* are referred to as "diaphragm" in this specification, the proportion and rigidity of each portion can be determined, for instance, depending on the material voltage resistance, workability, and the like. More specifically, the conductive portions 12*a* may be made thicker, so that the rigidity of the diaphragm 12 is determined by the conductive portions 12*a*. Alternatively, the portions 12*a* and 12*b* may have the same thickness. Also, the insulating portions 12*b* may be made thicker, so that the rigidity of the diaphragm 12 is determined by the insulating portions 12*b*.

In the prior art, concave portions are formed on either the diaphragm substrate or the electrode substrate, and the length of the gap between the diaphragm and a facing electrode is determined by the equation:

$$(\text{gap length})=(\text{concave depth})-(\text{electrode thickness})$$

Figure 13A:
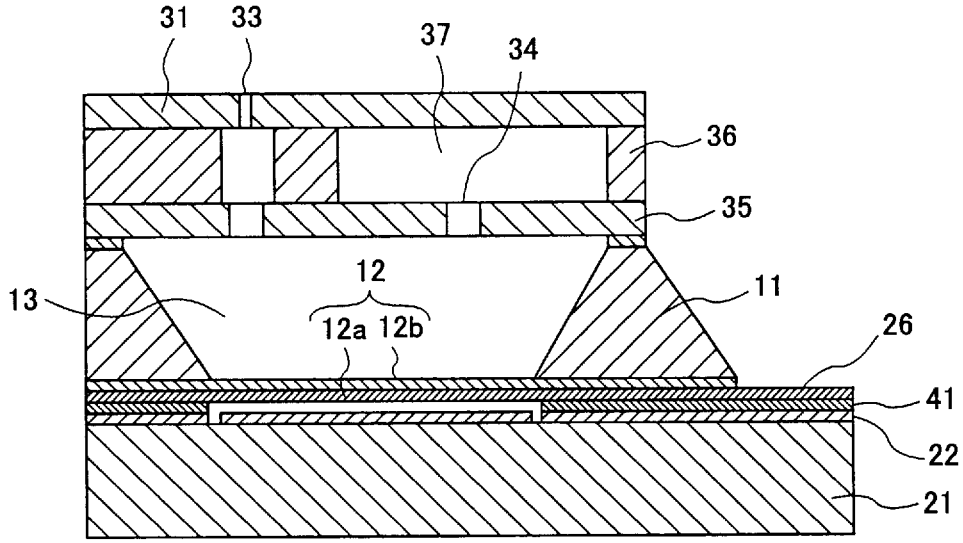
FIGS. 13A and 13B illustrate yet another embodiment of the electrostatic ink jet head of the present invention.
Figure 13B:
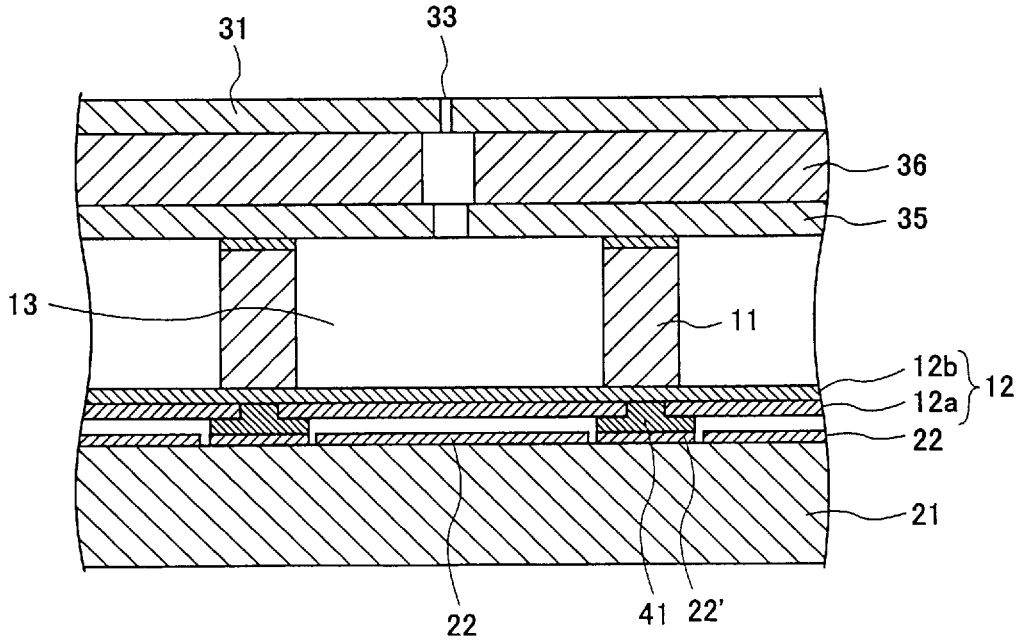

According to this equation, in a case where the gap length is small, it is difficult to form high-precision gaps. In this embodiment, however, the gap length is determined by the thickness of an insulating film 41. Accordingly, in the case where the gap length is small, the gap formation can be carried out at high precision. In such a case, the conductive portions 12*a* that serve as the individual diaphragm electrodes and the facing electrode 22 can be bonded to each other via the insulating film 41. The same effects as above can be obtained in a case where a conductive portion 12*a* of the diaphragm 12 is bonded to a facing electrode material that serves only as a gap spacer 22' that is the insulated facing electrode, as shown in FIGS. 13A and 13B. Also, the diaphragm electrode material separated from the diaphragm electrodes but bonded to the facing electrode (or to the facing electrode material) can attain the same effects.

The separated diaphragm electrodes are taken out only on the side of the facing electrode substrate 21 (the second substrate 21). This makes the packaging process easier, and the chip size can be reduced. However, there might be a case where it is more preferable to take out on the side of the diaphragm substrate 11 (the first substrate). In this embodiment, the diaphragm electrode (the conductive diaphragm 12*a*) is bonded to the common electrode (or the common electrode material). Because of this, the metal pad 26 can be used either on the first substrate side or on the second substrate side. Thus, more freedom can be allowed in design and packaging.

Figure 14A:
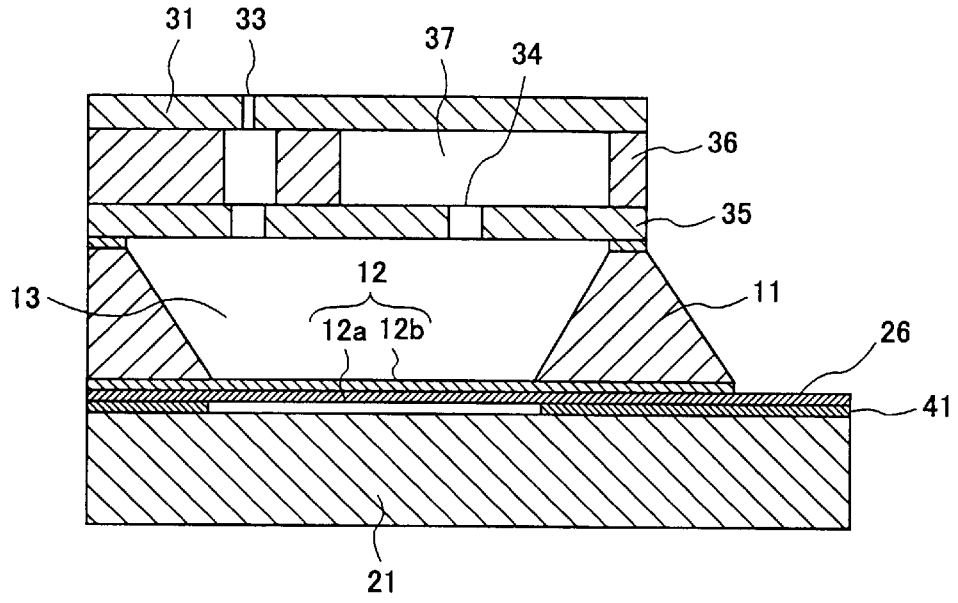
FIGS. 14A and 14B illustrate yet another embodiment of the electrostatic ink jet head of the present invention.
Figure 14B:
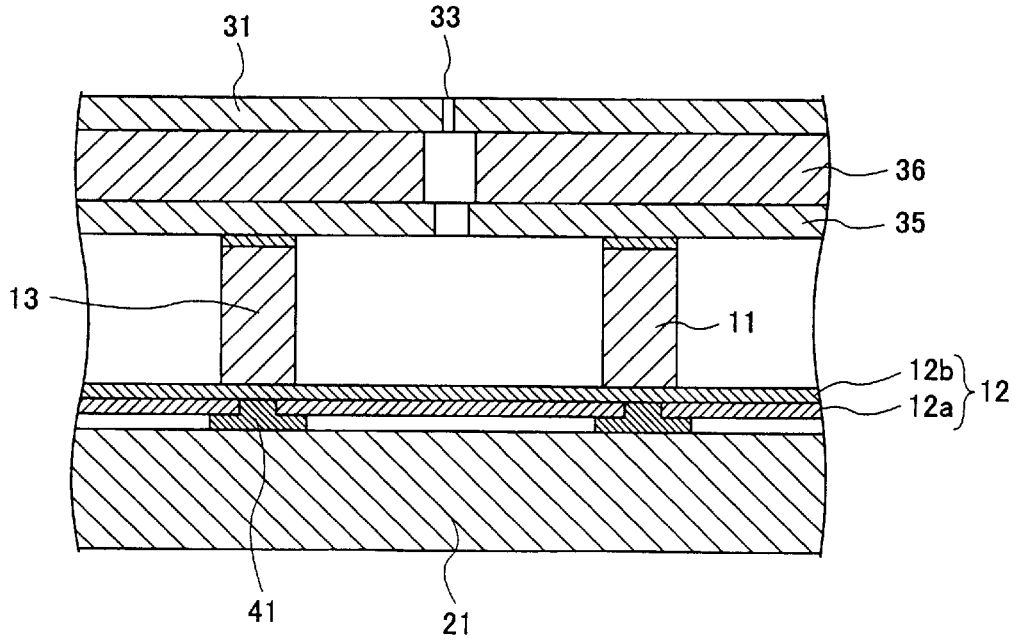
Figure 15:
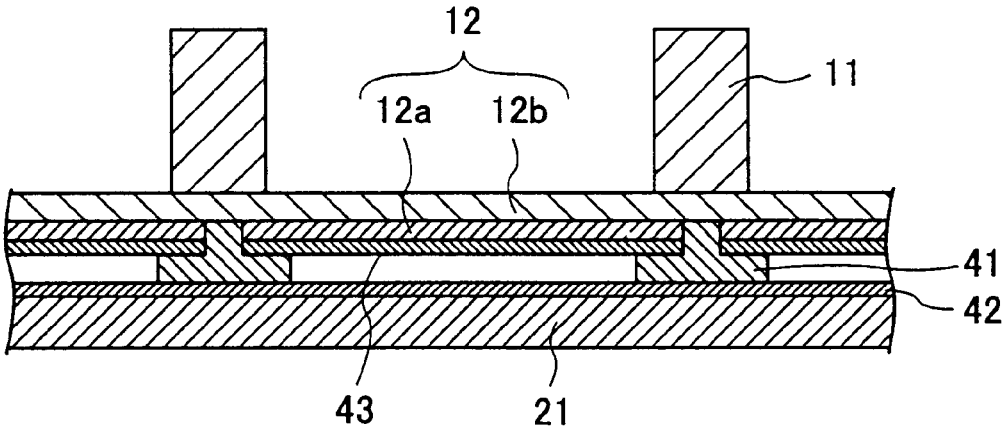
FIG. 15 is a sectional view of an example of a gap and a bonded area in the electrostatic ink jet head of the present invention.

If the electrode substrate 21 is made of a conductive material, the electrode substrate 21 can serve as the common facing electrode 22, as shown in FIGS. 14A and 14B, and the separate step of forming the facing electrode can be omitted. Accordingly, the entire structure can be simplified, and the number of production steps can be reduced. Thus, an ink jet head can be obtained at lower production costs.

FIGS. 15 to 22 are sectional views of various embodiments of the electrostatic ink jet head of the present invention. In the embodiment shown in FIG. 15, insulating films 43 and 42 are formed on the diaphragm 12 and the common facing electrode 22 (21), respectively. The insulating films 42 and 43 serve to prevent short-circuiting when the diaphragm 12 is brought into contact with the common facing electrode 22 (21), and to increase the reliability such as corrosion resistance. In terms of short-circuit prevention only, it is sufficient to provide either the diaphragm 12 or the common facing electrode 22 with an insulating film. The diaphragm substrate (the first substrate) 11 provided with the diaphragm 12 is then bonded to the common facing electrode 22 (21), with the insulating film 14 being interposed therebetween.

Figure 16:
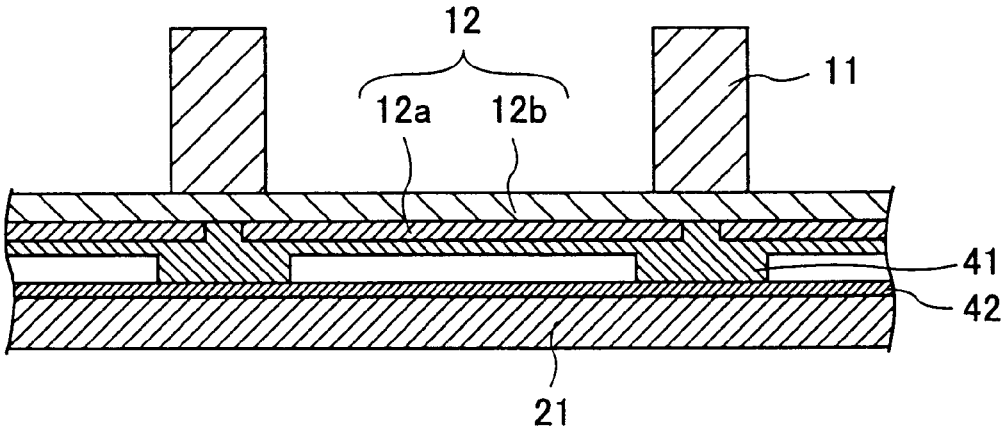
FIG. 16 is a sectional view of another example of the gap and the bonded area in the electrostatic ink jet head of the present invention.

In the embodiment shown in FIG. 16, concave portions are formed in the insulating film 41 formed on the surface of the diaphragm 12. The insulating film 41 is then bonded to the insulating film 42 formed on the surface of the common facing electrode 22 (21). In this case, the gap length is determined only by the depth of the concave portion. Accordingly, the gap formation can be carried out at higher precision than in the prior art.

Although a part of the insulating film remains on the diaphragm 12 in FIG. 16, it is also possible to completely remove the insulating film from the surface of the diaphragm 12.

Figure 17:
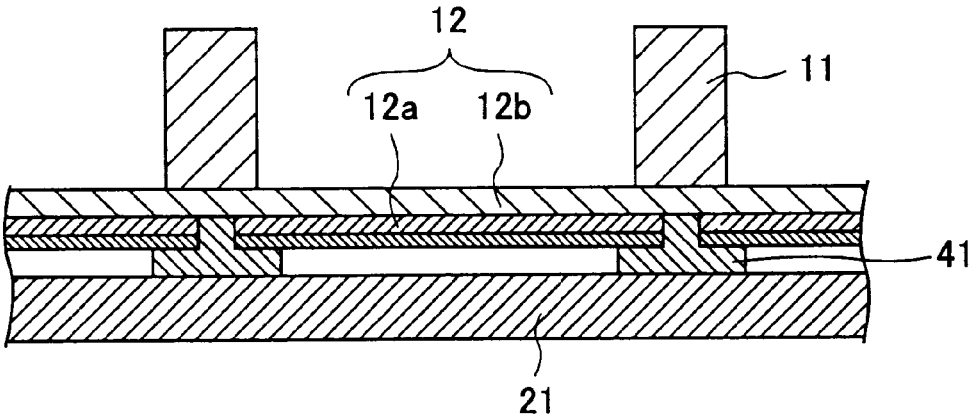
FIG. 17 is a sectional view of yet another example of the gap and the bonded area in the electrostatic ink jet head of the present invention.

The embodiment shown in FIG. 17 is the same as the embodiment shown in FIG. 16, except that no insulating film is formed on the common facing electrode 22 (21), and that the insulating film 41 is bonded to the common facing electrode 22 (21).

Figure 18:
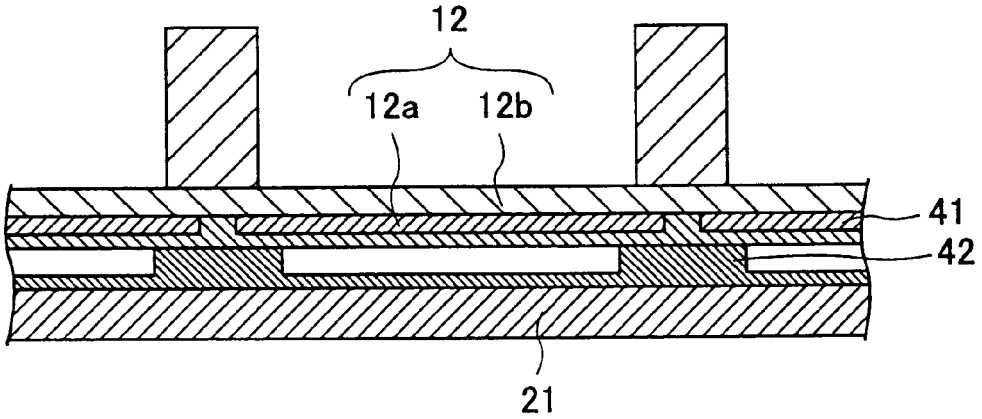
FIG. 18 is a sectional view of another example of the gap and the bonded area in the electrostatic ink jet head of the present invention.

In the embodiment shown in FIG. 18, concave portions are formed in the insulating film 42 formed on the common facing electrode 22 (21), and the insulating film 41 formed on the surface of the diaphragm 12 is bonded to the insulating film 42. In this case, the concave portions may be formed so that the surface of the common facing electrode 22 (21) is exposed. Alternatively, the insulating film 41 may not be formed on the surface of the diaphragm 12, and the insulating film 42 may be bonded directly to the diaphragm 12.

Figure 19:
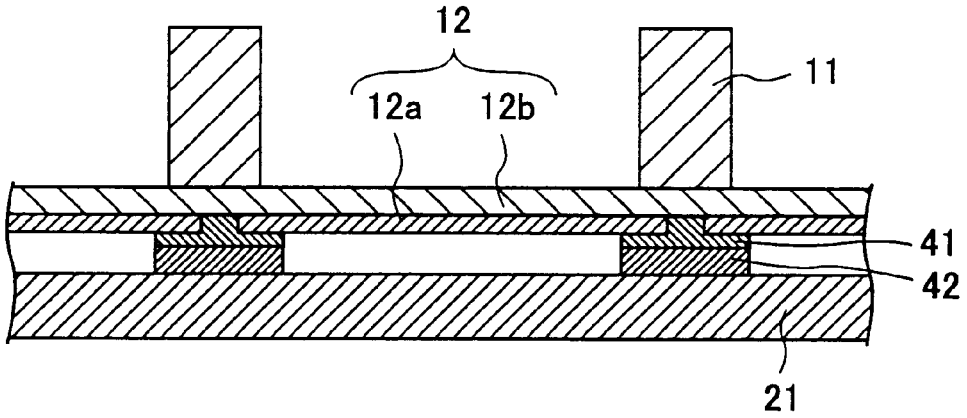
FIG. 19 is a sectional view of yet another example of the gap and the bonded area in the electrostatic ink jet head of the present invention.

In the embodiment shown in FIG. 19, the insulating film 41 formed on the surface of the diaphragm 12 is bonded to the insulating film 42 that serves as a gap spacer formed on the common facing electrode 22 (21). The gap length is determined by the total thickness of the insulating film 41 and the insulating film 42. In this case, the gap length is determined by the total of two parameters. Generally, the precision in gap length is better in a case where the gap length is determined by the sum of parameters than in a case where the gap length is determined by a difference between parameters. Accordingly, gap formation can be carried out at higher precision than in the prior art.

More specifically, in a case where the thickness of the insulating film 41 is 0.2 $\mu$m±0.02 $\mu$m (±10%) and the thickness of the insulating film 42 is 0.2 $\mu$m±0.02 $\mu$m (±10%), the gap length is 0.4 $\mu$m±0.04 $\mu$m (±10%). The precision in gap length remains ±10%. Those values are merely examples, and may vary depending on the used apparatus and conditions.

Figure 20:
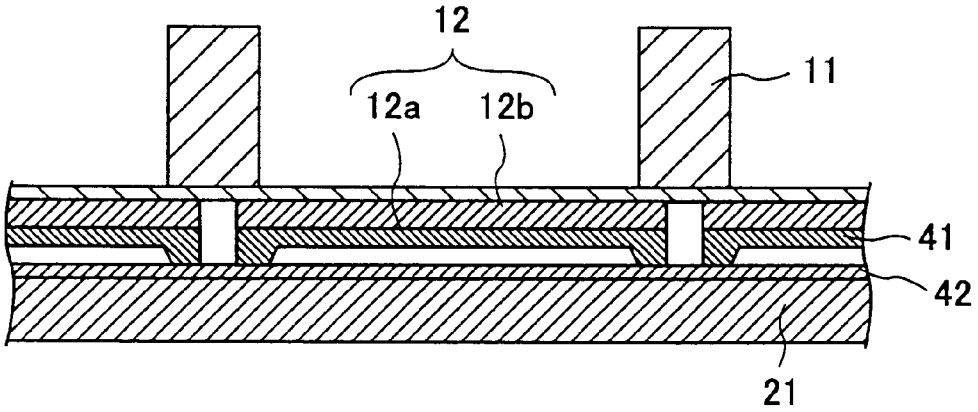
FIG. 20 is a sectional view of another example of the gap and the bonded area in the electrostatic ink jet head of the present invention.

In the embodiment shown in FIG. 20, concave portions to be diaphragm chambers (gaps) are formed in the insulating film 41 formed on the surface of the diaphragm 12. The insulating film 41 is then bonded to the insulating film 42 formed on the surface of the common facing electrode 21 (22), as in the embodiment shown in FIG. 16. This embodiment differs from the embodiment shown in FIG. 16 in that the side surfaces of each conductive portion 12*a* of the diaphragm 12 are not covered with the insulating film 41. Such a structure results from a case where separation grooves are formed after the formation of the insulating film on the conductive portions 12*a* of the diaphragm 12. Alternatively, if the conductive portions 12*a* of the diaphragm 12 are made of a material that can produce high-quality thermal oxide film (e.g. the conductive portions 12*a* are made of silicon), the side surfaces of each conductive portion 12*a* may be covered with oxide film after thermal oxidation.

Figure 21:
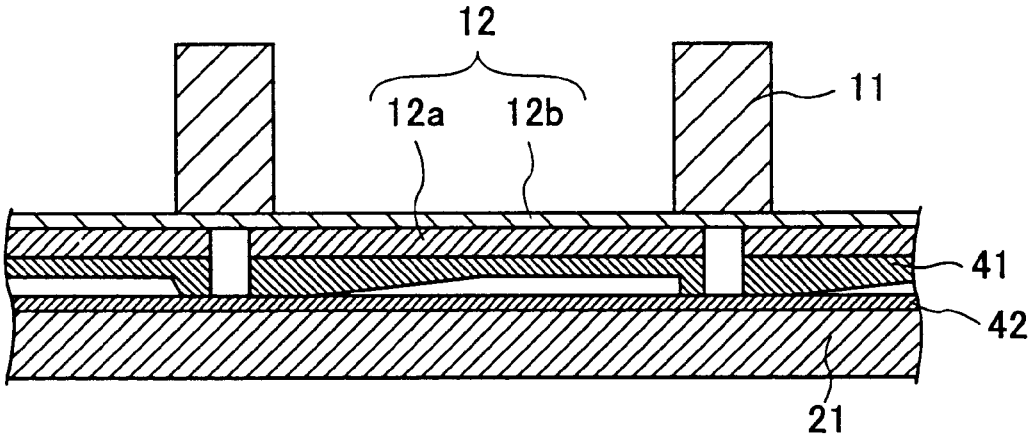
FIG. 21 is a sectional view of yet another example of the gap and the bonded area in the electrostatic ink jet head of the present invention.

The embodiment shown in FIG. 21 is substantially the same as the embodiment shown in FIG. 20, except that each gap does not have a parallel-configuration. Instead, one end of each gap is narrowed so as to obtain a lower driving voltage, and to avoid a collision between the diaphragm 12 and the facing electrode 22 (21). The configuration of each gap shown in FIG. 21 is merely an example. Both ends of each gap may be narrowed, or the inclination of each gap may vary depending on the situation. Also, each gap is formed by straight lines in FIG. 21, but it is possible to form each gap with curved lines. Furthermore, each non-parallel gap is formed in the insulating film 41 on the diaphragm 12 in FIG. 21, but it may also be formed in the insulating film 42 on the facing electrode 22 (21).

Figure 22:
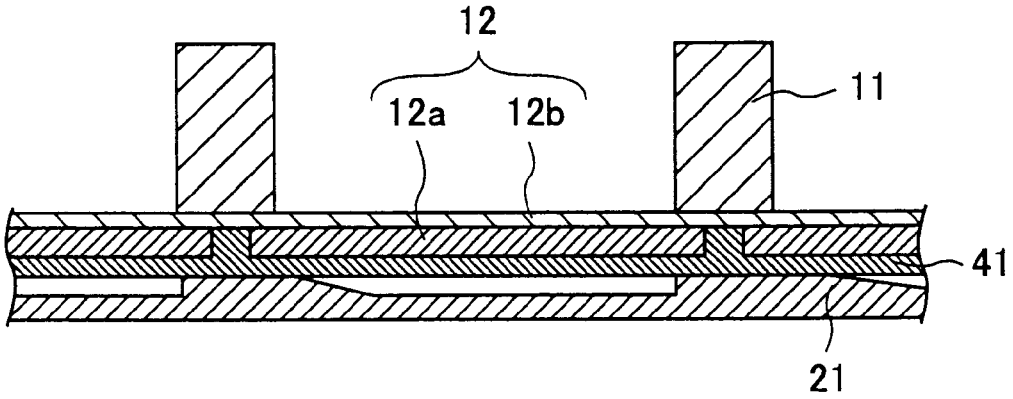
FIG. 22 is a sectional view of another example of the gap and the bonded area in the electrostatic ink jet head of the present invention.

In the embodiment shown in FIG. 22, the concave portions to be the gaps are formed in the facing electrode 21 (22). Each gap shown in FIG. 22 is narrowed at one end, but the shape of each gap is not limited to this. Also, the surface of the facing electrode 21 (22) may be covered with insulating film.

In all the above embodiments, the common facing electrode 22 may be separately formed on the electrode substrate 21. If the electrode substrate 21 is made of a conductive material, the electrode substrate 21 may also serve as the common facing electrode 22.

Also, various conventional materials and processes may be employed in the above embodiments, and there is no specific limitation to this end. As described above, however, if the electrode substrate 21 is made of a conductive material (a silicon wafer, for instance), the electrode substrate 21 may also serve as the common facing electrode 22, thereby eliminating the need to produce the common facing electrode 22. Thus, the number of production steps can be reduced.

As for the bonding technique, there is no specific limitation. However, if the insulating film 41 and the insulating film 42 are both made of silicon oxide film and have very smooth surfaces (Ra several Å or less), the "direct bonding" technique can be employed. The "direct bonding" technique is also used for WOI wafer production, and can provide very strong bonding between layers without any adhesive. The following is the process of "direct bonding".

(1) A silicon or silicon oxide film having a very smooth surface is made hydrophilic by subjecting its surface to a —OH radical. Generally, this process is carried out with a solution containing sulfuric acid and hydrogen peroxide.

(2) The silicon or the silicon oxide film having the hydrophilic surface is tightly attached to another silicon or silicon oxide film having a hydrophilic surface. As a result, the films are temporarily bonded to each other by hydrogen bonding.

(3) The hydrophilic surfaces of the silicon or silicon oxide films are then annealed at 700 to 1200° C., thereby diffusing $H_2O$. As a result, the hydrogen bonding is turned into covalent bonding of Si—O-is.

The surface smoothness required for direct bonding is believed to be Ra several Å or less. The direct bonding can be performed on the combination of silicon and silicon, silicon and silicon oxide film, or silicon oxide film and silicon oxide film.

By the "direct bonding", strong bonding can be obtained without adhesive, and the gap precision and the reliability can be made high.

To obtain a smooth oxide film surface, the following steps can be performed, for instance.

(1) Monocrystal silicon having a flat and smooth surface (a commercially available silicon wafer or SOI wafer normally satisfies this condition) is subjected to thermal oxidation so as to form an oxide film.

(2) An oxide processed by CVD or an oxide film surface obtained by subjecting polysilicon to oxidation is polished by CMP (Chemical Mechanical Polishing).

(3) After an oxide film is deposited, its surface is smoothed by reflow. If the oxide film has a low softening point, this process can be carried out at a lower temperature.

The direct bonding needs to be performed at a high temperature (700 to 1100° C.), it is necessary to use a substrate material and an electrode material having enough resistance to such a high temperature.

The direction bonding may be also performed on the combination of silicon and silicon oxide film (or silicon and silicon). In a case where at least either one of the diaphragm 12 and the facing common electrode 22 (21) is made of monocrystal silicon, the "direct bonding" can be performed on the combination of silicon and silicon oxide film, thereby eliminating the need to form one insulating film (silicon oxide film). For instance, the common facing electrode 22(21) is made of silicon while the insulating film 41 is a silicon oxide film, as shown in FIG. 18. To perform the direct bonding on the combination of silicon and silicon oxide film, the silicon surface also needs to be flat and smooth. Therefore, it is necessary to smooth the silicon surface by CMP or the like in advance.

With the diaphragm 12 being bonded to the common facing electrode 22 (21) via an insulating film, the diaphragm 12 can be sealed from the outside without a special step of sealing the diaphragm 12. In the prior art, however, the step of sealing is performed after several steps including the step of bonding the fist substrate 11 and the second substrate 21. In this embodiment, on the other hand, the diaphragm 12 is sealed at the time of bonding the two substrates. Thus, dust can be prevented from entering the ink jet head both during the production process and after the production process. Even if the diaphragm is deformed because it is sealed in the vicinity of the diaphragm chamber, the air in the gap is trapped in the diaphragm chamber, so that energy loss (gas damper effect) caused by the air coming into and out of the diaphragm chamber can be reduced. Thus, an ink jet head having higher efficiency can be obtained.

Furthermore, the diaphragm chamber can be evacuated, so as to reduce the influence from the air pressure. Accordingly, the driving voltage can be low. The reduced pressure (vacuum) in the diaphragm chamber can be obtained by depressurizing the bonding region between the diaphragm 12 and the facing electrode 22 (21).

Figure 23:
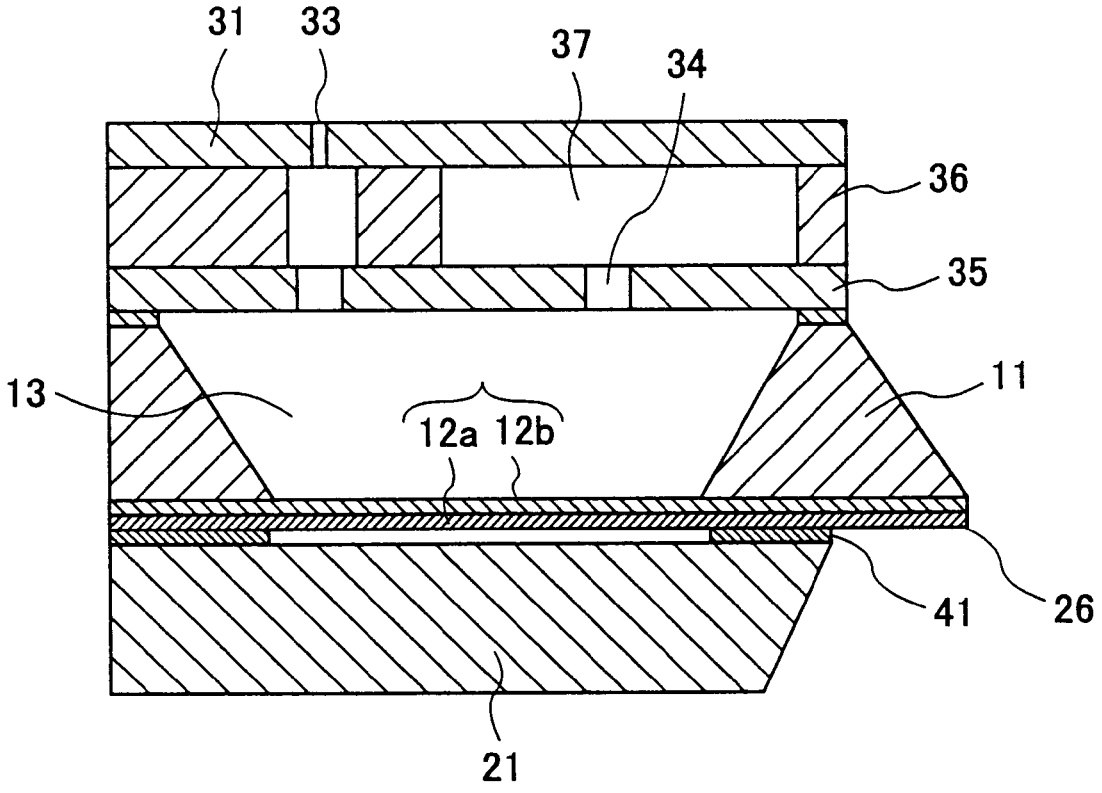
FIG. 23 illustrates an embodiment in which the diaphragm pad retrieval is performed in the direction of the electrode substrate.

FIG. 23 shows an embodiment in which the pad retrieval of the diaphragm 12 is carried out in the direction of the electrode substrate (second substrate) 22. This structure can be easily produced, and the area for pad retrieval can be reduced. Accordingly, the chip size can be reduced, and direct electric connection with a mount board can be attained. Thus, the mounting process can be simplified, and the production costs can be reduced. Also, since the mounting area (including the mount board) can be reduced, the chip area can be reduced accordingly.

Figure 24A:
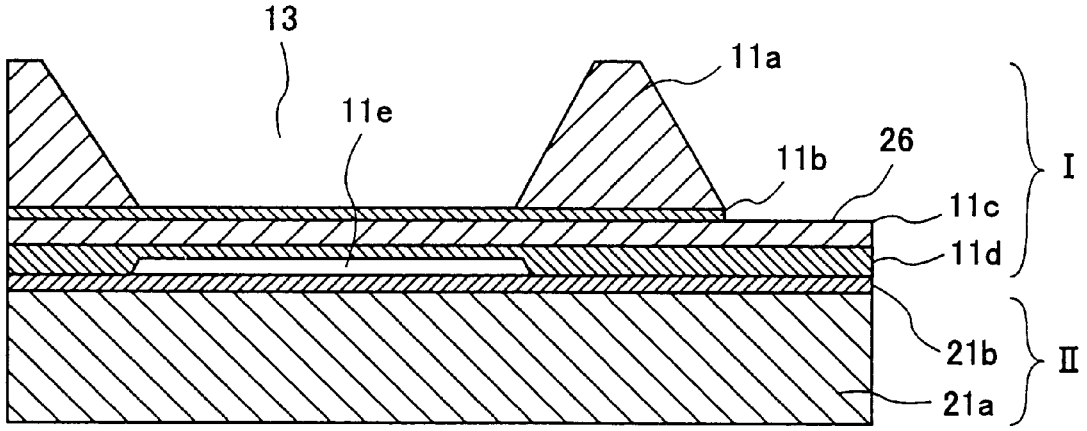
FIGS. 24A and 24B are sectional views of an ink jet head using an SOI substrate as the diaphragm substrate (first substrate)
Figure 24B:
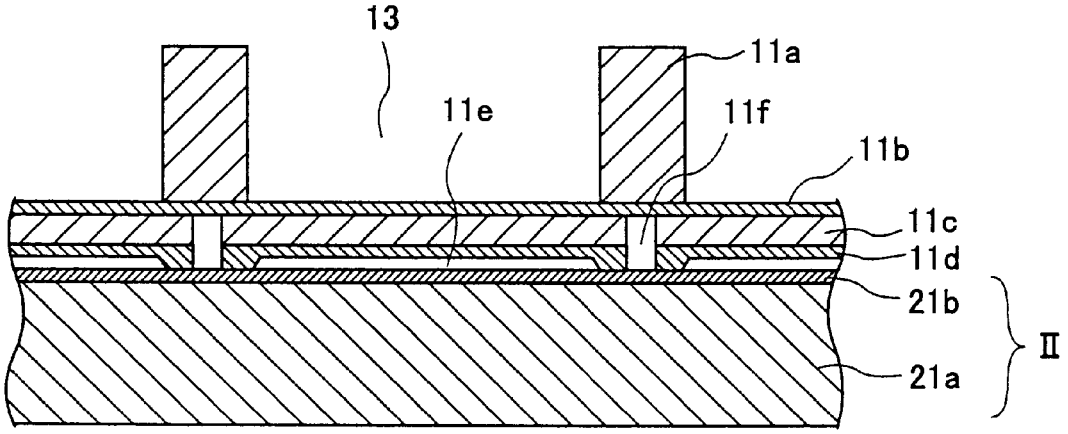

FIGS. 24A and 24B show an embodiment in which an SOI substrate is used as the diaphragm substrate (first substrate), the monocrystal silicon of the SOI substrate is used as the diaphragm, a monocrystal silicon substrate is used as the electrode substrate (second substrate), and the diaphragm substrate and the electrode substrate are bonded to each other by the direct bonding technique. FIG. 24A is a longitudinal-direction sectional view of one individual bit of the ink jet head of this embodiment, and FIG. 24B is a transverse-direction sectional view of the same. As shown in FIGS. 24A and 24B, the ink jet head of this embodiment comprises a first substrate (diaphragm substrate) I and a second substrate (electrode substrate) II. The diaphragm substrate (first substrate) I comprises separation walls 11*a,* an insulating film 11*b,* a monocrystal silicon diaphragm 11*c,* and a silicon oxide film 11*d.* Those components form the ink pressure chambers 13, the metal pad 26, the diaphragm chambers (gap) 11*e,* and diaphragm separation grooves 11*f.* The electrode substrate (second substrate) II comprises a monocrystal silicon substrate 21*a* and a silicon oxide film 21*b.* The first substrate I and the second substrate II are bonded to each other by the direct bonding technique.

Figure 25A:
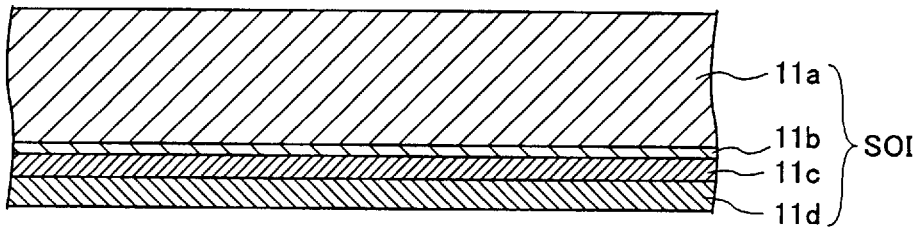
FIGS. 25A to 25E illustrate the procedure of producing the ink jet head shown in FIGS. 24A and 24B.
Figure 25B:
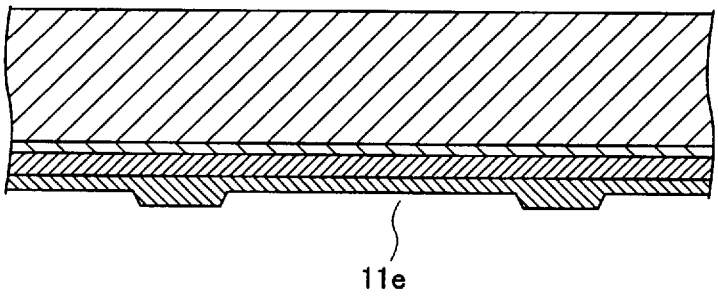
Figure 25C:
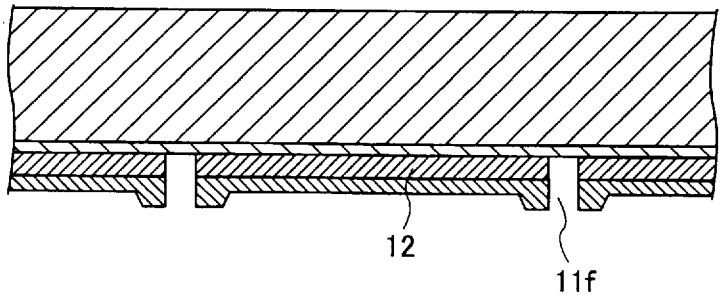
Figure 25D:
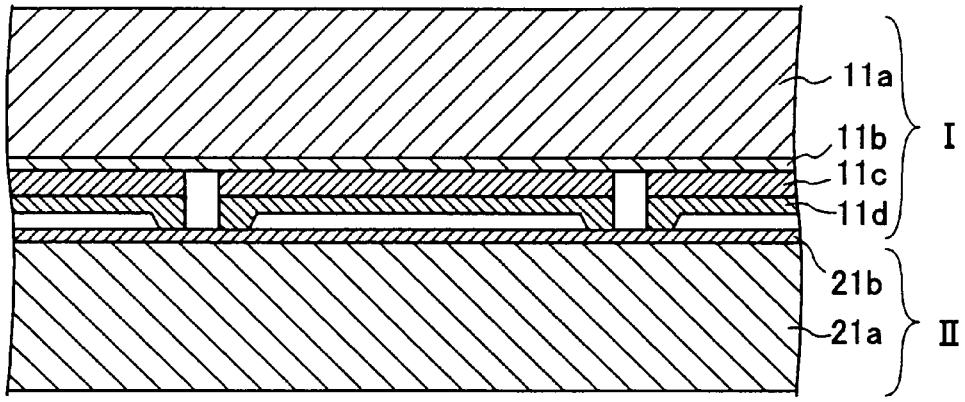
Figure 25E:
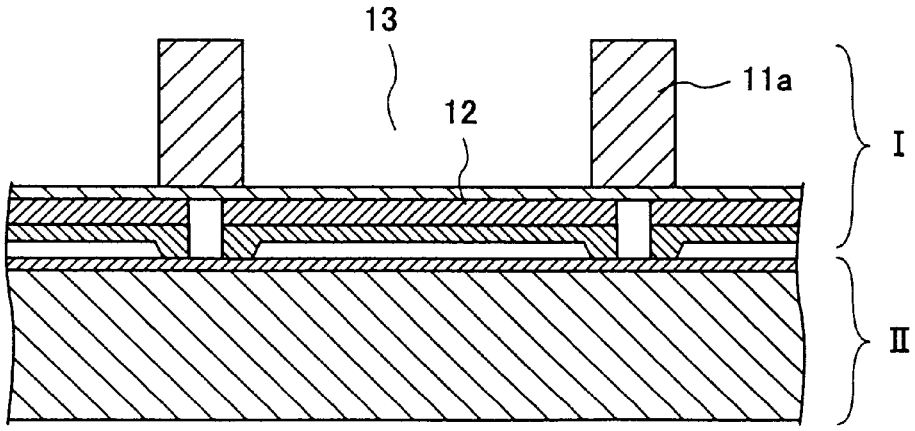

FIGS. 25A to 25E illustrate the procedure of producing the ink jet head shown in FIGS. 24A and 24B. More specifically, FIGS. 25A to 25C illustrate the procedure of producing the first substrate (diaphragm substrate) I. FIGS. 25D and 25E illustrate the steps of bonding the first substrate and the second substrate to each other and then forming the ink pressure chamber 13 in the first substrate I.

Step (a): The silicon oxide film (thermal oxide film) 11*d* having a thickness of approximately 0.5 μm is formed on the SOI wafer that consists of the monocrystal silicon substrate 11*a* (a <110> substrate, 40 μm in thickness), the silicon oxide film 11*b* (0.5 μm in thickness), and the monocrystal silicon layer 11*c* (2 to 3 μm in thickness), as shown in FIG. 25A.

Step (b): A concave portion (diaphragm chamber 11*e*) having a depth of approximately 0.3 μm is formed in the thermal oxide film 11*d* by oxidation film etching, as shown in FIG. 25B.

Step (c): The diaphragm 12 is separated by the diaphragm separation grooves 11*f* penetrating through the silicon film lid and the monocrystal silicon oxide film 11*c.* The diaphragm separation grooves 11*f* are formed at both sides of the concave portion (diaphragm chamber 11*e*), as shown in FIG. 25C.

Step (d): The two insulating films (i.e., the silicon oxide films 11*d* and 21*b*) are bonded directly to each other, so that the diaphragm substrate (first substrate) I produced in steps (a) to (c) is bonded to the electrode substrate (second substrate) II made up of the monocrystal silicon substrate 21*a* and the silicon oxide film 21*b,* as shown in FIG. 25D. Alternatively, a thermal oxide film is formed on the silicon oxide film of the electrode substrate II, if necessary, and the direction bonding is then performed.

Step (e): After the first substrate I and the second substrate II are bonded to each other, a mask layer containing SiN is formed on the first substrate I. The ink pressure chamber 13 and the diaphragm 12 are then formed, as shown in FIG. 25E, by subjecting the mask layer to photolithography, silicon anisotropic etching, or mask etching using a KOH solution. Alternatively, after the formation of the ink pressure chamber 13 and the diaphragm 12, the first substrate 1 and the second substrate II are bonded to each other, thereby completing the ink jet head shown in FIGS. 24A and 24B.

The present invention is not limited to the specifically disclosed embodiments, but variations and modifications may be made without departing from the scope of the present invention.

The present invention is based on Japanese priority application Nos. 11-224541, filed on Aug. 6, 1999, and 2000-214078, filed on Jul. 14, 2000, the entire contents of which are hereby incorporated by reference.

What is claimed is:

1. An electrostatic ink jet head, comprising:

a plurality of nozzles through which ink droplets are discharged;

a plurality of ink passages that communicate with the nozzles;

a diaphragm that forms a part of each of the ink passages and has a common electrode;

a plurality of individual electrodes that face the diaphragm; and spacers, each of which maintains a gap between the diaphragm and each of the individual electrodes, wherein:

a driving voltage is applied between the common electrode and the individual electrodes, so that the diaphragm is deformed by electrostatic force to pressurize ink in the ink passages, at least a part of the spacer is made of the same material as the individual electrodes.

2. The electrostatic ink jet head as claimed in claim 1, wherein:

the individual electrodes and a part of the spacer are made of monocrystal silicon; and the remaining part of the spacer is formed from silicon oxide film.

3. The electrostatic ink jet head as claimed in claim 1, further comprising:

an electrode supporting substrate that supports the individual electrodes;

through holes, each of which penetrates through the electrode supporting substrate from a bottom side surface thereof to each corresponding individual electrode; and electrode retrieve pads formed on the bottom side surface of the electrode supporting substrate.

4. The electrostatic ink jet head as claimed in claim 3, wherein:

the electrode supporting electrode is a <110> silicon substrate; and a surface of each of the through holes has a (111) plane.

5. The electrostatic ink jet head as claimed in claim 2, wherein the electrode supporting substrate is a silicon substrate that has a higher dopant concentration than that of the individual electrodes.

6. A method of producing an electrostatic ink jet head that comprises: a plurality of nozzles through which ink droplets are discharged; a plurality of ink passages that communicate with the nozzles; a diaphragm that forms a part of each of the ink passages and has a common electrode; a plurality of individual electrodes that face the diaphragm; and spacers, each of which maintains a gap between the diaphragm and each of the individual electrodes, the diaphragm being deformed by electrostatic force to pressurize ink in the ink passages, said method comprising the steps of:

oxidizing an SOI substrate that is used as an electrode supporting substrate;

performing etching on a part of a resultant oxide film; and performing etching to form a separation groove between each of the individual electrodes and each corresponding one of the spacers.

7. The method as claimed in claim 6, further comprising the step of forming through holes after the formation of a material to be the individual electrodes on the electrode supporting substrate.

8. An ink jet head that discharges ink droplets through nozzles by deforming a diaphragm by electrostatic force caused by a driving voltage applied between a common electrode formed on the diaphragm and individual electrodes, said ink jet head comprising:

a liquid chamber substrate provided with the diaphragm that forms a part of each of liquid chambers communicating with the nozzles;

an electrode substrate having the individual electrodes facing the diaphragm via a gap; wherein the liquid chamber substrate and the electrode substrate are bonded to each other on the same plane, with an insulating layer being interposed therebetween.

9. The ink jet head as claimed in claim 8, wherein:

the liquid chamber substrate and the electrode substrate are both made of monocrystal silicon; and the insulating layer interposed between the liquid chamber substrate and the electrode substrate is formed from silicon oxide film.

10. The ink jet head as claimed in claim 8, wherein in a bonding region between the liquid chamber substrate and the electrode substrate, each of the individual electrodes is taken out with a pad on the opposite surface from the liquid chamber substrate.

11. An ink jet head comprising:

a plurality of nozzles through which ink droplets are discharged:

a plurality of liquid chambers that respectively communicate with the plurality of nozzles;

a diaphragm that is made of a conductive material and forms at least a part of each of the liquid chambers;

a first substrate that includes the liquid chambers and the diaphragm; and a second substrate that has electrodes, which electrodes facing the diaphragm, wherein:

the ink droplets are discharged through the nozzles by deforming the diaphragm with electrostatic force generated by a voltage applied between the diaphragm and an electrode facing the diaphragm via a gap;

a part of the diaphragm made of a conductive material is electrically separated from each of the nozzles;

the electrode facing the diaphragm serves as a common electrode; and the first substrate and the second substrate are bonded to each other on the same single plane, with an insulating layer being interposed therebetween.

12. The ink jet head as claimed in claim 11, wherein the second substrate is made of a conductive material, and serves as the common electrode.

13. The ink jet head as claimed in claim 11, wherein the first substrate and the second substrate are bonded to each other, with a silicon oxide film being interposed therebetween.

14. The ink jet head as claimed in claim 11, wherein at least one of the diaphragm and the common electrode is made of monocrystal silicon.

15. The ink jet head as claimed in claim 11, wherein:

the first substrate is an S0I (Silicon on Insulator) substrate;

at least a part of the diaphragm is made of monocrystal silicon;

the second substrate is a monocrystal silicon substrate; and the first substrate and the second substrate are bonded to each other, with a silicon oxide film being interposed therebetween.

* * * * *

UNITED STATES PATENT AND TRADEMARK OFFICE

CERTIFICATE OF CORRECTION

PATENT NO. : 6,406,133 B1
DATED : June 18, 2002
INVENTOR(S) : Shuya Abe

It is certified that error appears in the above-identified patent and that said Letters Patent is hereby corrected as shown below:

Title page,
Item [30], please change
"Aug. 3, 2000 (JP) ……. 2000-214078" to
-- Jul. 14, 2000 (JP) …….. 2000-214078 --.

Signed and Sealed this

Twenty-sixth Day of November, 2002

*Attest:*

*Attesting Officer*

JAMES E. ROGAN
*Director of the United States Patent and Trademark Office*